US011281153B2

(12) United States Patent
Ikegami et al.

(10) Patent No.: US 11,281,153 B2
(45) Date of Patent: Mar. 22, 2022

(54) IMAGE FORMING APPARATUS AND GEAR TRAIN

(71) Applicant: BROTHER KOGYO KABUSHIKI KAISHA, Nagoya (JP)

(72) Inventors: Yusuke Ikegami, Aichi (JP); Kotaro Haruta, Yokkaichi (JP); Shoichiro Nishimura, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/212,460

(22) Filed: Mar. 25, 2021

(65) Prior Publication Data

US 2021/0325821 A1 Oct. 21, 2021

(30) Foreign Application Priority Data

Apr. 15, 2020 (JP) ..... JP2020-073081

(51) Int. Cl.
*G03G 21/16* (2006.01)
*G03G 15/01* (2006.01)
*G03G 21/18* (2006.01)

(52) U.S. Cl.
CPC ..... *G03G 21/1647* (2013.01); *G03G 15/0121* (2013.01); *G03G 21/1661* (2013.01); *G03G 21/1857* (2013.01)

(58) Field of Classification Search
CPC ..... G03G 15/0121; G03G 15/5008; G03G 21/1647; G03G 21/1661; G03G 21/1857; G03G 2221/1657
See application file for complete search history.

(56) References Cited

U.S. PATENT DOCUMENTS

2015/0093152 A1* 4/2015 Hashimoto ..... G03G 21/1647 399/223
2015/0277261 A1 10/2015 Suzuki
2016/0349664 A1 12/2016 Sawashima
2020/0004198 A1* 1/2020 Nakano ..... G03G 15/0121
2020/0310281 A1* 10/2020 Haruta ..... G03G 21/1857
2021/0011427 A1* 1/2021 Saeki ..... G03G 21/1857

FOREIGN PATENT DOCUMENTS

JP 2015-191210 A 11/2015
JP 2016-224418 A 12/2016

* cited by examiner

*Primary Examiner* — Sophia S Chen
(74) *Attorney, Agent, or Firm* — Merchant & Gould P.C.

(57) ABSTRACT

An image forming apparatus, having a first photosensitive drum, a second photosensitive drum, a first developing roller, a second developing roller, a first moving mechanism, a second moving mechanism, a driving gear, a motor, a first gear train, a second gear train, and a third gear train, is provided. The first gear train having a first gear transmits a driving force from the motor to the first developing roller. The second gear train having a second gear transmits the driving force from the motor to the second developing roller. The second gear train is provided separately from the first gear train. The third gear train having a third gear transmits the driving force from the motor to at least one of the first moving mechanism and the second moving mechanism. The third gear train is provided separately from the first gear train and the second gear train.

9 Claims, 14 Drawing Sheets

IMAGE FORMING APPARATUS AND GEAR TRAIN

CROSS REFERENCE TO RELATED APPLICATION

This application claims priority from Japanese Patent Application No. 2020-073081, filed on Apr. 15, 2020, the entire subject matter of which is incorporated herein by reference.

BACKGROUND

Technical Field

An aspect of the present disclosure is related to an image forming apparatus, having a plurality of photosensitive drums and a plurality of developing rollers.

Related Art

An image forming apparatus having a plurality of photosensitive drums, a plurality of developing rollers, a moving mechanism, and a motor, capable of multicolor printing is known. Each of the developing rollers may be movable between a contacting position, in which the developing roller contacts a corresponding one of the photosensitive drums, and a separated position, in which the developing roller is separated from the corresponding one of photosensitive drums. The movable mechanism may move the developing rollers between the respective contacting positions and the respective separated positions. The motor may supply a driving force to the developing rollers and the moving mechanism.

The image forming apparatus may have a first development-gear train, a first development contact/separation gear train, a second development-gear train, and a second development contact/separation gear train. The first development-gear train may transmit the driving force from the motor to the developing rollers for multicolor printing. The first development contact/separation gear train may be branched from the first development-gear train and transmit the driving force from the motor to the moving mechanism to move the developing rollers for multicolor printing between the respective contacting positions and the respective separated positions. The second development-gear train may transmit the driving force from the motor to the developing roller for monochrome printing. The second development contact/separation gear train may be branched from the second development-gear train and transmit the driving force from the motor to the moving mechanism to move the developing roller for monochrome printing between the contacting position and the separated position.

SUMMARY

In order to prolong consumable lives of the developing rollers and toners in the image forming apparatus, it may be suggested that each of the developing rollers is separated from the corresponding photosensitive drum as soon as the developing roller finishes developing images. In order to achieve the suggested arrangement in the image forming apparatus employing the known driving-force transmission mechanism, torque to drive the moving mechanism may fluctuate as the moving mechanism moves the developing rollers. Fluctuation of the torque may affect the gear trains to cause, for example, the gears to rotate ununiformly. As a result, the developing rollers that are in developing operations may rotate unstably, and image may not be formed correctly.

The present disclosure is advantageous in that an image forming apparatus, in which fluctuation of torque to drive a moving mechanism may be restrained from affecting gear trains transmitting a driving force from a motor to developing rollers, is provided.

According to an aspect of the present disclosure, an image forming apparatus, having a first photosensitive drum, a second photosensitive drum, a first developing roller, a second developing roller, a first moving mechanism, a second moving mechanism, a driving gear, a motor, a first gear train, a second gear train, and a third gear train, is provided. The first developing roller is movable between a contacting position, in which the first developing roller contacts the first photosensitive drum, and a separated position, in which the first developing roller is separated from the first photosensitive drum. The second developing roller is movable between a contacting position, in which the second developing roller contacts the second photosensitive drum, and a separated position, in which the second developing roller is separated from the second photosensitive drum. The first moving mechanism is configured to move the first developing roller between the contacting position and the separated position. The second moving mechanism is configured to move the second developing roller between the contacting position and the separated position. The motor is configured to drive the driving gear. The first gear train has a first gear meshing directly with the driving gear and is configured to transmit a driving force from the motor to the first developing roller. The second gear train has a second gear meshing directly with the driving gear and is configured to transmit the driving force from the motor to the second developing roller. The second gear train is provided separately from the first gear train. The third gear train has a third gear meshing directly with the driving gear and is configured to transmit the driving force from the motor to at least one of the first moving mechanism and the second moving mechanism. The third gear train is provided separately from the first gear train and the second gear train.

BRIEF DESCRIPTION OF THE ACCOMPANYING DRAWINGS

DETAILED DESCRIPTION

Hereinafter, an embodiment of the present disclosure will be described with reference to the accompanying drawings.

Figure 1:
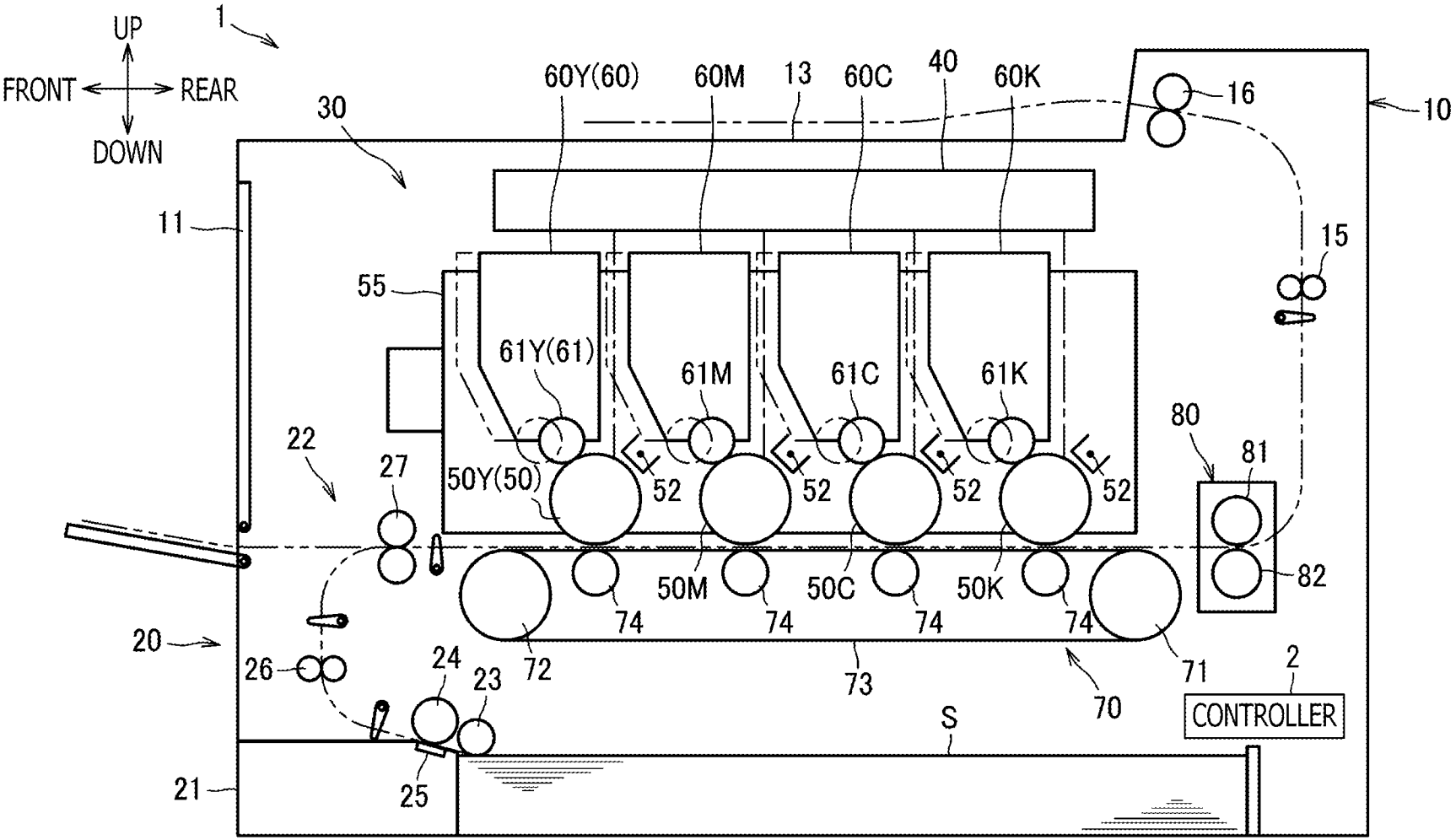
FIG. 1 is an overall cross-sectional view of an image forming apparatus according to an embodiment of the present disclosure.

As shown in FIG. 1, an image forming apparatus 1 according to the embodiment is a multicolor printer and has a casing 10, a sheet feeder 20, an image forming device 30, and a controller 2. In the following description, directions related the image forming apparatus 1 and each part or item included in the image forming apparatus 1 will be referred to on basis of indications by arrows in the drawings. For example, in FIG. 1, a viewer's a left-hand side, a right-hand side, an upper side, and a lower side will be referred to as a front side, a rear side, an upper side, and a lower side, respectively. Moreover, a farther side and a nearer side to the viewer viewing FIG. 1 will be referred to as a leftward side and a rightward side to the image forming apparatus 1, respectively. A front-to-rear or a rear-to-front direction may be referred to as a front-rear direction, a left-to-right or right-to-left direction may be referred to as a widthwise direction, and an up-to-down or down-to-up direction may be referred to as a vertical direction.

The sheet feeder 20 includes a sheet tray 21 to store sheets S and a feeder device 22. The sheet tray 21 is arranged at a position below the image forming device 30 and is movable to be pulled frontward, e.g., leftward in FIG. 1, to be detached from the casing 10. The feeder device 22 includes a feeder roller 23, a separator roller 24, a separator pad 25, a conveyer roller 26, and a registration roller 27. The sheet(s) S in the present embodiment is a printing medium, on which the image forming apparatus 1 may form an image, and includes, but not necessarily be limited to, regular paper, envelope, postcard, tracing paper, cardboard, resin sheet, and sticker sheet.

The sheets S stored in the sheet tray 21 may be picked up by the feeder roller 23, separated one by one from the other sheets S by the separator roller 24 and the separator pad 25, and conveyed by the conveyer roller 26 to the registration roller 27. As the separated sheet S is conveyed further, a position of a leading edge of the sheet S may be regulated by the registration roller 27, which may be pausing. Thereafter, as the registration roller 27 starts rotating, the sheet S may be fed to the image forming device 30.

The image forming device 30 includes an exposure device 40, a plurality of photosensitive drums 50, a plurality of developing cartridges 60, a conveyer 70, and a fuser 80.

The exposure device 40 includes laser diodes, deflectors, lenses, and mirrors, which are not shown. The exposure device 40 may emit laser beams at the photosensitive drums 50 to expose the photosensitive drums 50 to the light and to scan surfaces of the photosensitive drums 50.

The photosensitive drums 50 include a Y-photosensitive drum 50Y, an M-photosensitive drum 50M, a C-photosensitive drum 50C, and a K-photosensitive drum 50K, which are provided to correspond to colors of yellow, magenta, cyan, and black on one-to-one basis. In the following paragraphs and the accompanying drawings, a color to which an item corresponds may be identified by a suffix Y, M, C, or K, representing yellow, magenta, cyan, or black, respectively, appended to a reference sign of the item. On the other hand, when items are described generally without necessity of referring to the corresponding colors thereto, the items may be described collectively in a singular form with a single reference sign without the suffix Y, M, C, or K; and the prefix signs Y-, M-, C-, and K- may be omitted.

The developing cartridge 60 is provided correspondingly to the photosensitive drum 50. In particular, the developing cartridge 60 includes a Y-developing cartridge 60Y, an M-developing cartridge 60M, a C-developing cartridge 60C, and a K-developing cartridge 60K. The Y-developing cartridge 60Y includes a Y-developing roller 61Y, which may supply yellow toner to the Y-photosensitive drum 50Y. The M-developing cartridge 60M includes an M-developing roller 61M, which may supply magenta toner to the M-photosensitive drum 50M. The C-developing cartridge 60C includes a C-developing roller 61C, which may supply cyan toner to the C-photosensitive drum 50C. The K-developing cartridge 60K includes a K-developing roller 61K, which may supply black toner to the K-photosensitive drum 50K.

The Y-developing roller 61Y, the M-developing roller 61M, and the C-developing roller 61C are arranged in line in this recited order from upstream to downstream in a sheet-conveying direction. The K-developing roller 61K is arranged at a position downstream from the C-developing roller 61C in the sheet-conveying direction. In other words, the Y-developing roller 61Y, the M-developing roller 61M, the C-developing roller 61C, and the K-developing roller 61K are arranged in line in this recited order from upstream to downstream in the sheet-moving direction: The Y-developing roller 61Y is at a most upstream position, the M-developing roller 61M is at a second upstream position next to the Y-developing roller 61Y, the C-developing roller 61C is at a third upstream position next to the M-developing roller 61, and the K-developing roller 61K is at a most downstream position, in the sheet-moving direction. The sheet-moving direction is a direction, in which the sheet S is conveyed in the belt unit 70 (e.g., rearward in FIG. 1 and rightward to a viewer).

The developing cartridge 60 is movable between a position, in which the developing roller 61 being at a contacting position contacts the corresponding photosensitive drum 50, as indicated by solid lines in FIG. 1, and a position, in which the developing roller 61 being at a separated position is separated from the corresponding photosensitive drum 50, as indicated by dash-and-dots lines in FIG. 1. In other words, the Y-developing roller 61 Y is movable between the contacting position thereof to contact the Y-photosensitive drum 50Y and the separated position thereof to be separated from the Y-photosensitive drum 50Y, the M-developing roller 61M is movable between the contacting position thereof to contact the M-photosensitive drum 50M and the separated position thereof to be separated from the M-photosensitive drum 50M, the C-developing roller 61C is movable between the contacting position thereof to contact the C-photosensitive drum 50C and the separated position thereof to be separated from the C-photosensitive drum 50C, and the K-developing roller 61K is movable between the contacting position thereof to contact the K-photosensitive drum 50K and the separated position thereof to be separated from the K-photosensitive drum 50K.

The photosensitive drum 50 is rotatably supported by a supporting member 55. On the supporting member 55, chargers 52 are arranged. Each charger 52 is provided correspondingly to each of the Y-, M-, C-, K-photosensitive drums 50Y, 50M, 50C, 50K and may electrically charge the corresponding one of the Y-, M-, C-, K-photosensitive drums 50Y, 50M, 50C, 50K. The supporting member 55 is detachably attachable to the casing 10 through an opening (not shown), which may be exposed when a front cover 11 of the casing 10 is open. The supporting member 55 supports the developing cartridge 60 removably.

The conveyer 70 is arranged between the sheet tray 21 and the photosensitive drum 50. The conveyer 70 includes a driving roller 71, a driven roller 72, a conveyer belt 73 being an endless belt, and four (4) transfer rollers 74. The conveyer belt 73 is strained around the driving roller 71 and the driven roller 72, with an upper outer surface thereof contacting the photosensitive drum 50. The transfer rollers 74 are arranged inside the conveyer belt 73 to nip the conveyer belt 73 in cooperation with the Y-, M-, C-, K-photosensitive drums 50Y, 50M, 50C, 50K.

The fuser 80 is arranged at a rearward position with respect to the photosensitive drum 50 and the conveyer 70. The fuser 80 includes a heating roller 81 and a pressing roller 82 arranged to face the heating roller 81 to nip the sheet S at a position between the heating roller 81 and the pressing roller 82. At positions downstream from the fuser 80 in the sheet-conveying direction, arranged are a conveyer roller 15 and an ejection roller 16.

In the image forming device 30, the surface of the photosensitive drum 50 may be charged evenly by the charger 52 and selectively exposed to the light emitted from the exposure device 40. Thereby, electrostatic latent images based on image data may be formed on the surface of the photosensitive drum 50. Meanwhile, the toner in the developing cartridge 60 may be supplied to the surface of the developing roller 61 and may be supplied to the electrostatic latent image formed on the surface of the photosensitive drum 50. Thus, the toner image may be formed on the photosensitive drum 50.

When the sheet S on the conveyer belt 73 passes through the position between the photosensitive drum 50 and the transfer roller 74, the toner image formed on the photosensitive drum 50 may be transferred onto the sheet S. As the sheet S is conveyed to pass through the position between the heating roller 81 and the pressing roller 82, the toner images transferred to the sheet S may be fused to the sheet S. The sheet S ejected from the fuser 80 may be conveyed by the conveyer roller 15 and the ejection roller 16 to rest on an ejection tray 13 formed on an upper face of the casing 10.

Figure 2:
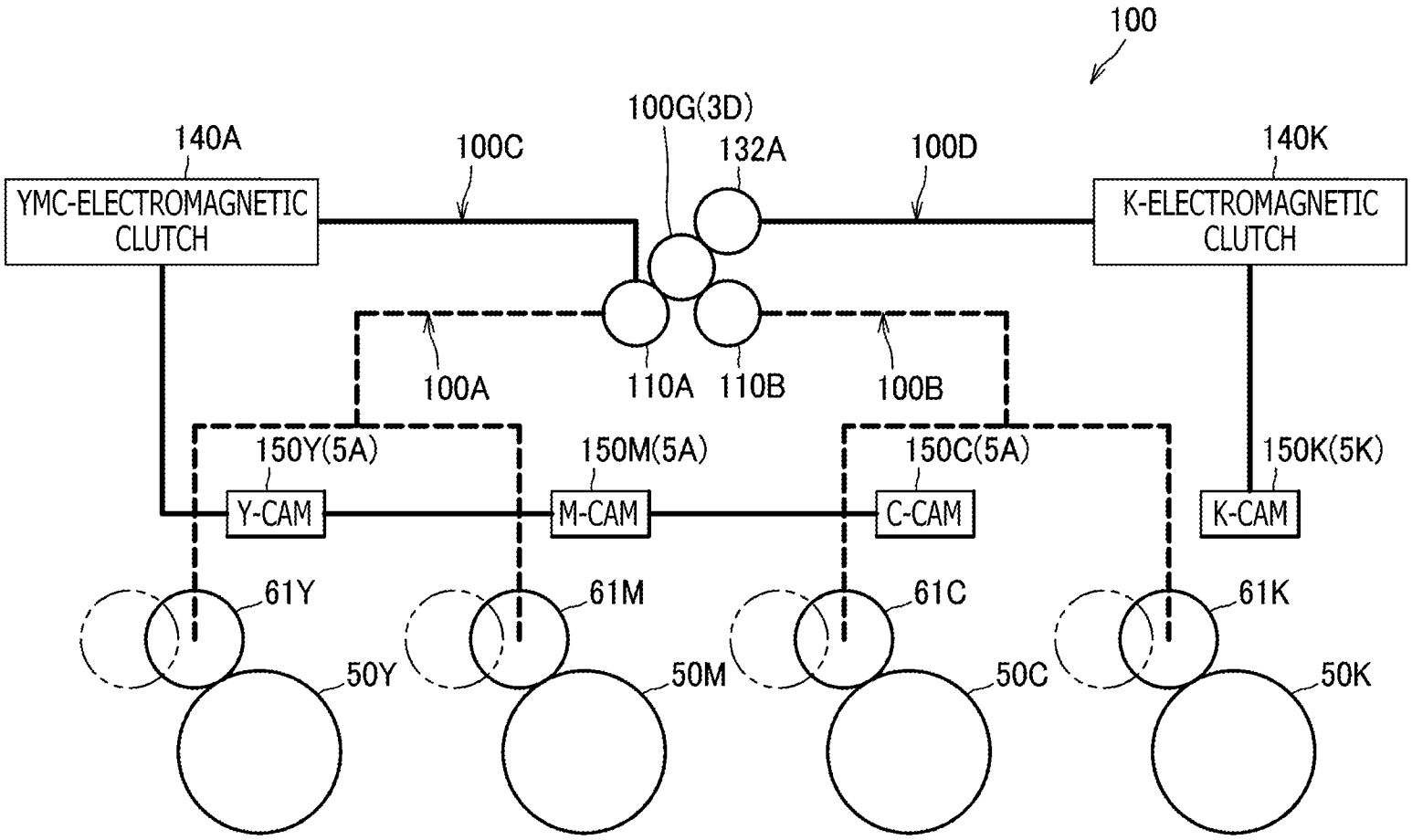
FIG. 2 is a schematic diagram to illustrate a driving-force transmission mechanism in the image forming apparatus according to the embodiment of the present disclosure.

The image forming apparatus 1 further includes, as shown in FIG. 2, a development motor 3D, a YMC-moving mechanism 5A, a K-moving mechanism 5K, and a driving-force transmission mechanism 100.

The development motor 3D is a driving source, which may drive a development-driving gear 100G to drive the developing roller 61 and cams 150 in the YMC- and K-moving mechanisms 5A, 5K. The cams 150 include a Y-cam 150Y, an M-cam 150M, a C-cam 150C, and a K-cam 150K for the colors of yellow, magenta, cyan, and black.

The YMC-moving mechanism 5A may move the Y-developing roller 61Y, the M-developing roller 61M, and the C-developing roller 61C between respective contacting positions and respective separated positions. The YMC-moving mechanism 5A includes the Y-cam 150Y, the M-cam 150M, and the C-cam 150C. The K-moving mechanism 5K may move the K-developing roller K between a contacting position and a separated position and includes the K-cam 150K.

The driving-force transmission mechanism 100 may transmit the driving force from the development motor 3D to the developing roller 61 and the cam 150. The driving-force transmission mechanism 100 includes a development-driving gear 100G, a first development-gear train 100A, a second development-gear train 100B, a first control-gear train 100C, and a second control-gear train 100D. In FIG. 2, the first and second development-gear trains 100A, 100B are indicated in thicker broken lines, and the first and second control-gear trains 100C, 100D are indicated in thicker solid lines.

The first development-gear train 100A may transmit the driving force from the development motor 3D to the Y-developing roller 61Y and the M-developing roller 61M. The second development-gear train 100B may transmit the driving force from the development motor 3D to the C-developing roller 61C and the K-developing roller 61K. The first development-gear train 100A and the second development-gear train 100B are provided separately from each other.

The first control-gear train 100C may transmit the driving force from the development motor 3D to the Y-, M-, C-cams 150Y, 150M, 150C, which form the YMC-moving mechanism 5A. The second control-gear train 100D may transmit the driving force from the development motor 3D to the K-cam 150K, which forms the K-moving mechanism 5K. The first control-gear train 100C and the second control-gear train 100D are provided separately from each other. The first control-gear train 100C is branched from the first development-gear train 100A. In other words, the first control-gear 100C is connected to the first development-gear train 100A. On the other hand, the second control-gear 100D is provided separately from the first development-gear train 100A and from the second development-gear train 100B.

Figure 3:
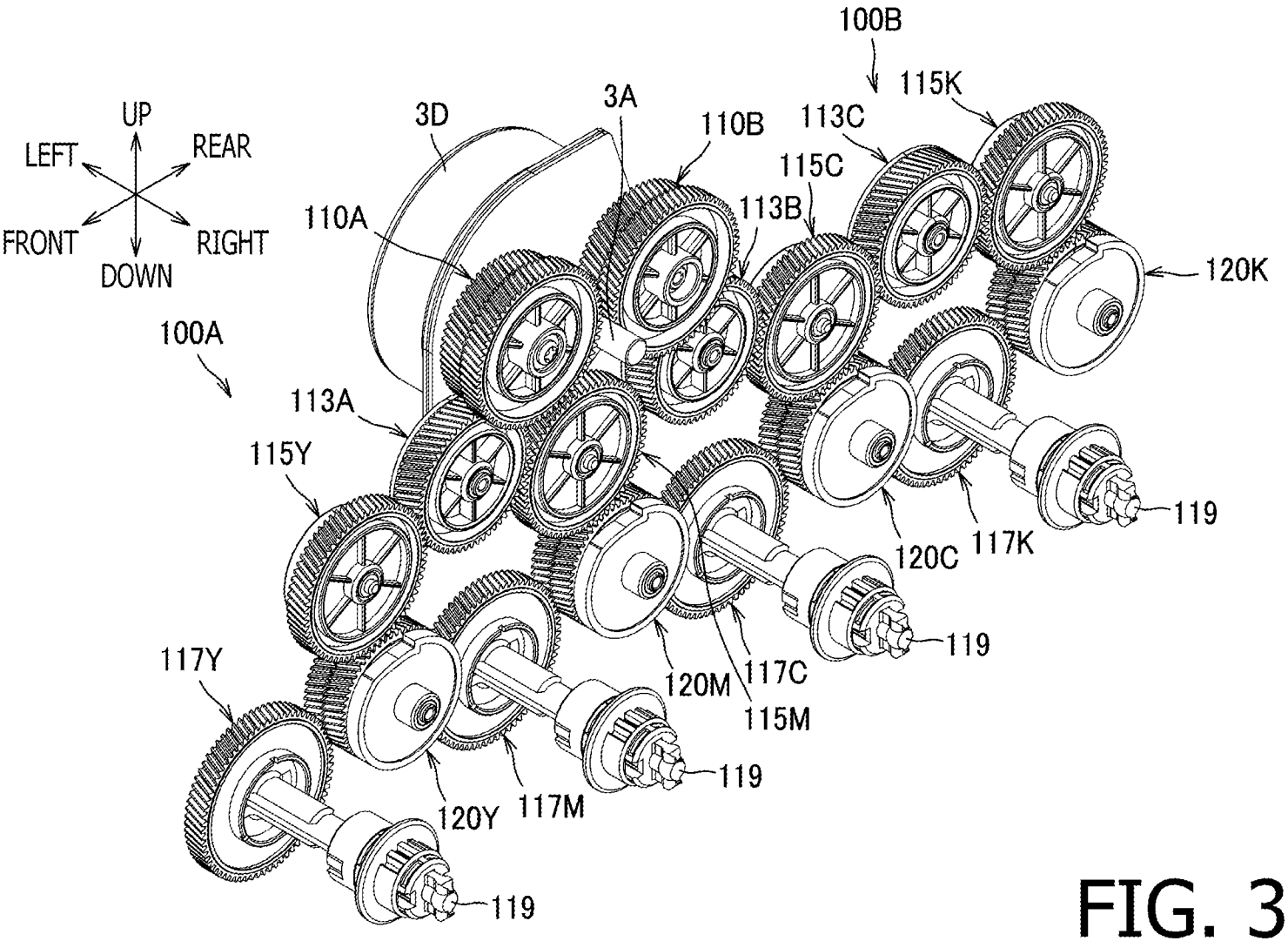
FIG. 3 is a perspective view of a development motor and a development-gear train in the image forming apparatus according to the embodiment of the present disclosure from an upper-right viewpoint.
Figure 4:
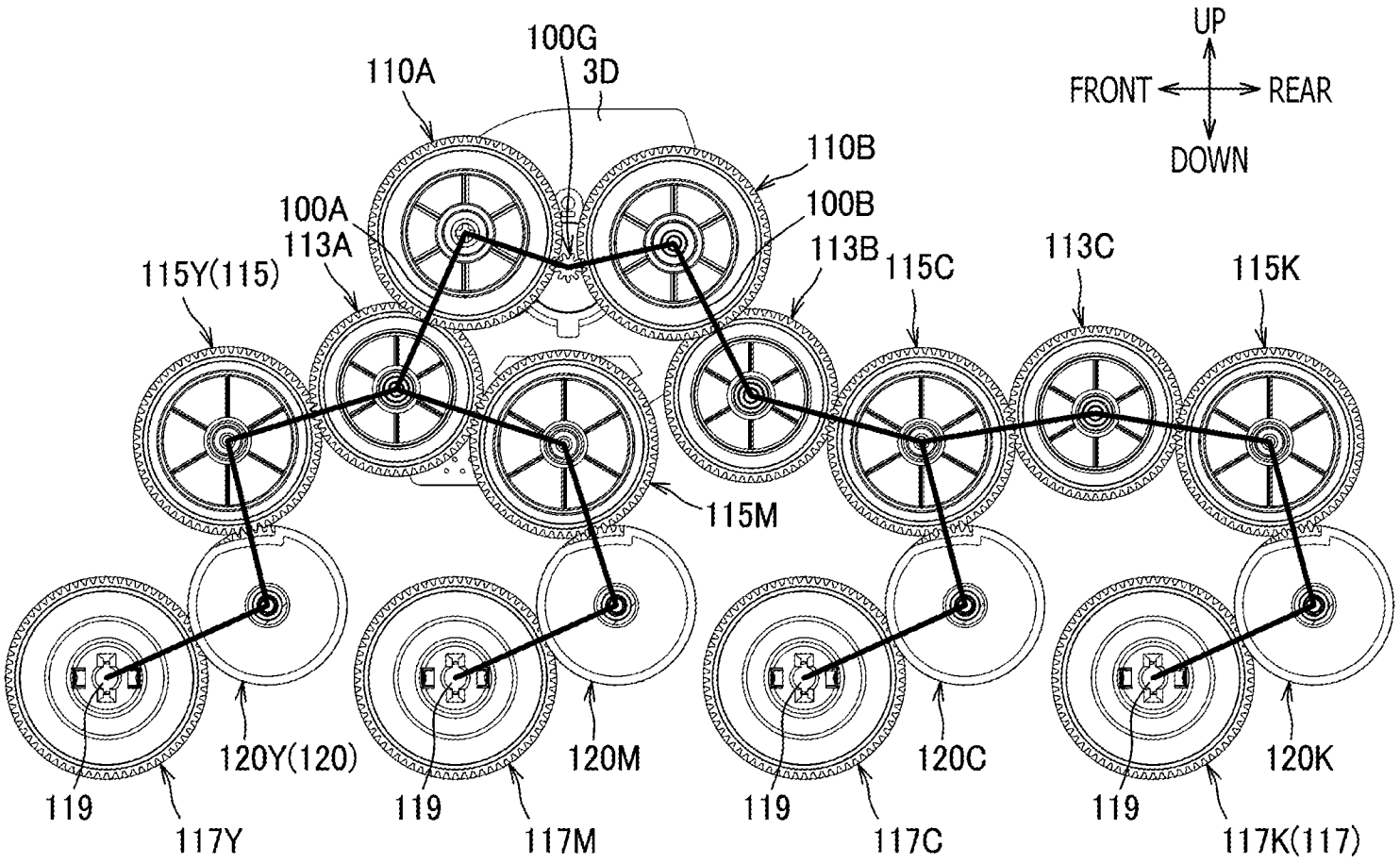
FIG. 4 is a rightward side view of the development motor and the development-gear train in the image forming apparatus according to the embodiment of the present disclosure.
Figure 5:
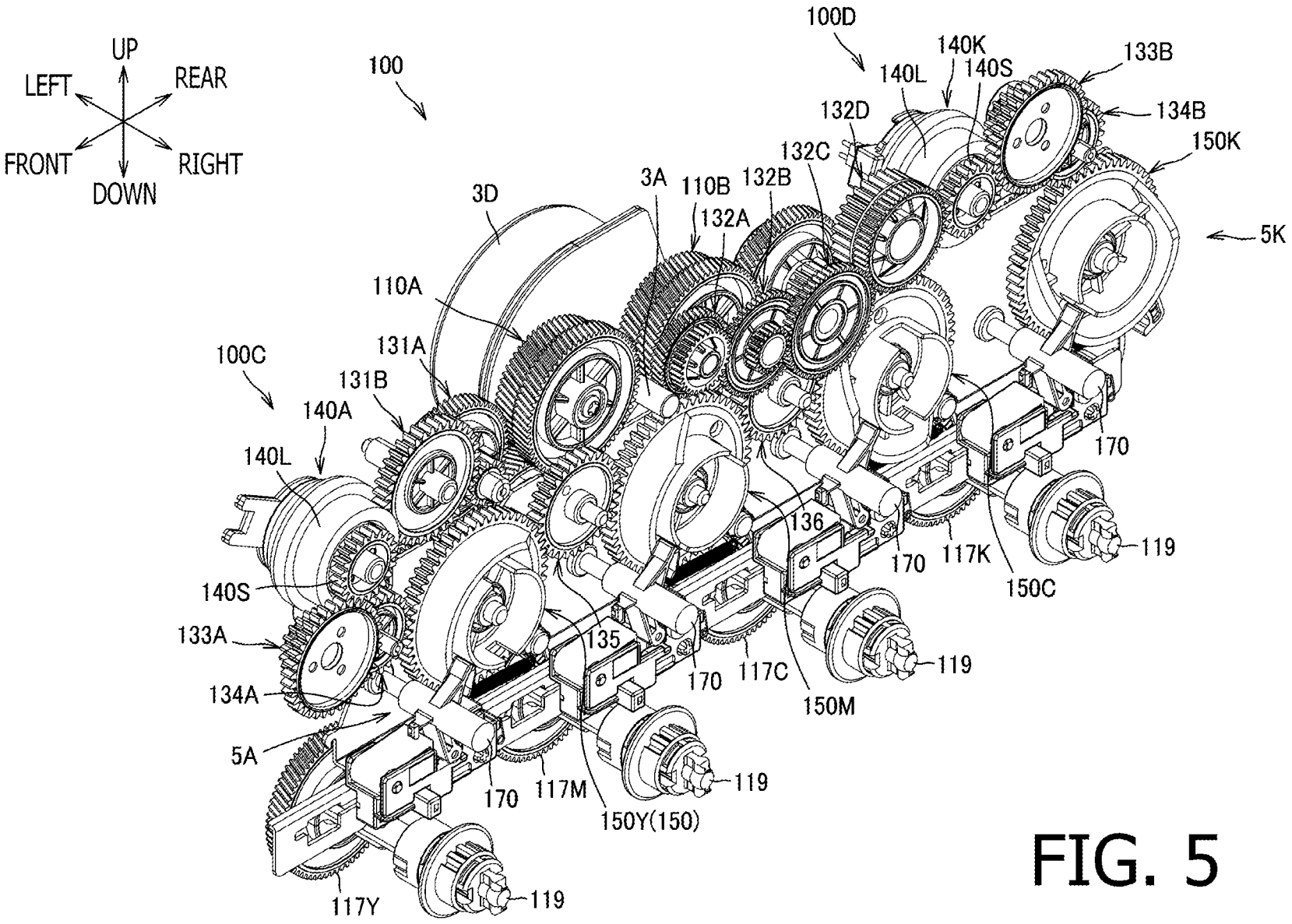
FIG. 5 is a perspective view of the development motor, the driving-force transmission mechanism, and a moving mechanism in the image forming apparatus according to the embodiment of the present disclosure from an upper-right viewpoint.
Figure 6:
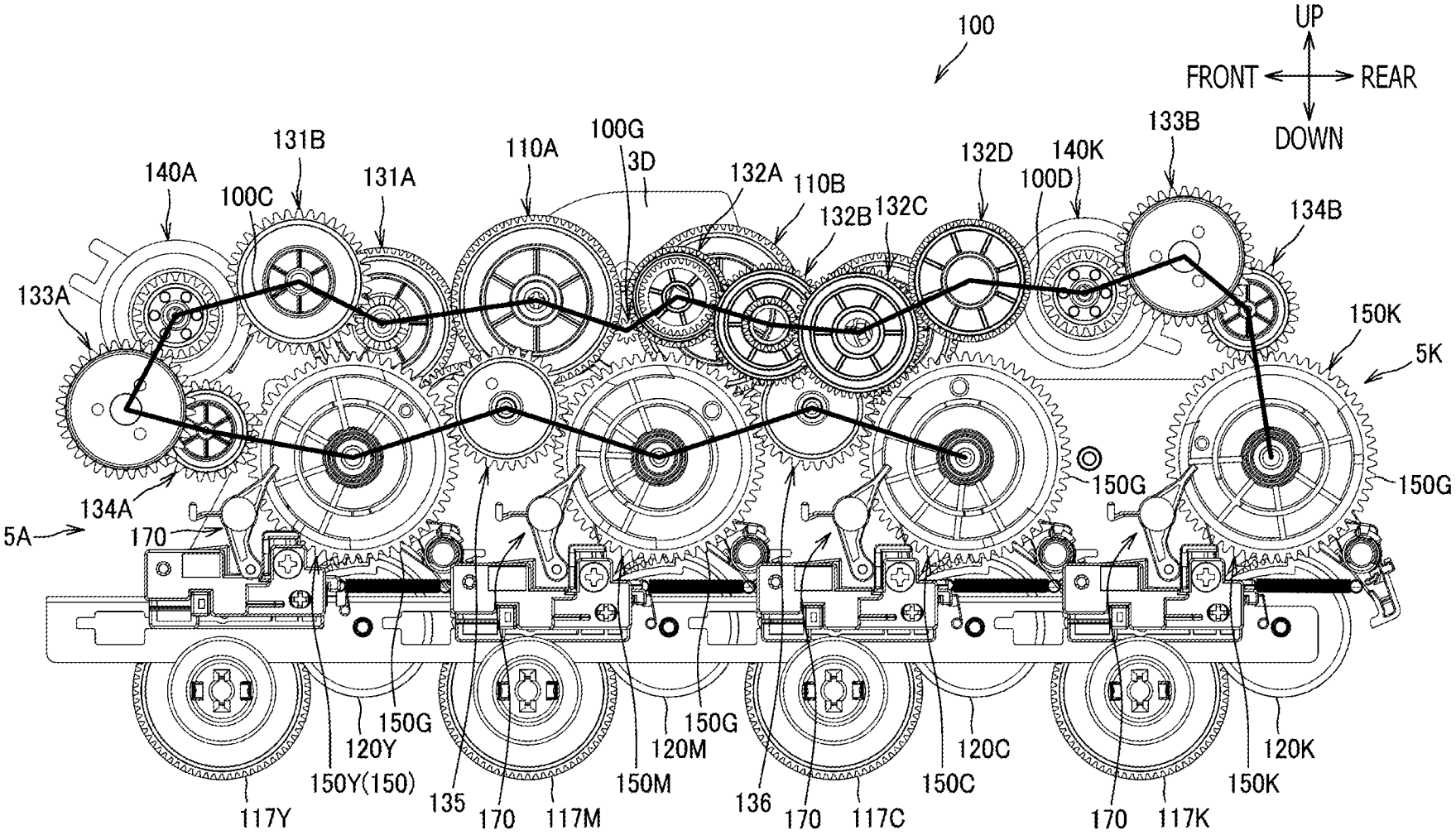
FIG. 6 is a rightward side view of the development motor, the driving-force transmission mechanism, and the moving mechanism in the image forming apparatus according to the embodiment of the present disclosure.

Next, configurations of the driving-force transmission mechanism 100 and the YMC- and K-moving mechanisms 5A, 5K will be described in detail. FIGS. 3 and 4 mainly show the first and second development-gear trains 100A, 100B. FIGS. 5 and 6 mainly show the first and second control-gear trains 100C, 100D and the YMC- and K-moving mechanisms 5A, 5K, which are arranged on a rightward side of the first and second development-gear trains 100A, 100B. In FIGS. 4 and 6, intermeshing transmitting flows through the gears in the first and second development-gear trains 100A, 100B and the first and second control-gear trains 100C, 100D are indicated in thicker solid lines.

As shown in FIGS. 3 and 4, the development-driving gear 100G is a gear attached to an output shaft 3A of the development motor 3D. The development-driving gear 100G may rotate integrally with the output shaft 3A by activation of the development motor 3D.

The first development-gear train 100A includes idle gears 110A, 113A, 115Y, 115M, a Y-clutch 120Y, an M-clutch 120M, a Y-coupling gear 117Y, and an M-coupling gear 117M.

The idle gear 110A meshes directly with the development-driving gear 100G and is arranged at a frontward position with respect to the development-driving gear 100G. The idle gear 113A is located at a position below the idle gear 110A and meshes directly with the idle gear 110A.

The idle gear 115Y is arranged at a frontward position with respect to the idle gear 113A and meshes directly with the idle gear 113A. The Y-clutch 120Y is arranged at a position below the idle gear 115Y and meshes directly with the idle gear 115Y. The clutch 120, including Y-, M-, C-, K-clutches 120Y, 120M, 120C, 120K for the colors of yellow, magenta, cyan, and black, will be described later.

The Y-coupling gear 117Y may output the driving force from the development motor 3D input through the idle gear 110A to the Y-developing roller 61Y. The Y-coupling gear 117Y is arranged at a frontward position with respect to the Y-clutch 120Y and meshes directly with the Y-clutch 120Y. To the Y-coupling gear 117Y, the driving force from the development motor 3D may be transmitted through the idle gears 110A, 113A, 115Y, and the Y-clutch 120Y.

The idle gear 115M is arranged at a rearward position with respect to the idle gear 113A and meshes directly with the idle gear 113A. The M-clutch 120M is arranged at a position below the idle gear 115M and meshes directly with the idle gear 115M.

The M-coupling gear 117M may output the driving force from the development motor 3D input through the idle gear 110A to the M-developing roller 61M. The M-coupling gear 117M is arranged at a frontward position with respect to the M-clutch 120M and meshes directly with the M-clutch 120M. To the M-coupling gear 117M, the driving force from the development motor 3D may be transmitted through the idle gears 110A, 113A, 115M, and the M-clutch 120M.

The second development-gear train 100B includes idle gears 110B, 113B, 115C, 113C, 115K, the C-clutch 120C, the K-clutch 120K, a C-coupling gear 117C, and a K-coupling gear 117K.

The idle gear 110B meshes directly with the development-driving gear 100G and is arranged at a rearward position with respect to the development-driving gear 100G. The idle gear 113B is located at a position below the idle gear 110B and meshes directly with the idle gear 110B.

The idle gear 115C is arranged at a rearward position with respect to the idle gear 113B and meshes directly with the idle gear 113B. The C-clutch 120C is arranged at a position below the idle gear 115C and meshes directly with the idle gear 115C.

The C-coupling gear 117C may output the driving force from the development motor 3D input through the idle gear 110B to the C-developing roller 61C. The C-coupling gear 117C is arranged at a frontward position with respect to the C-clutch 120C and meshes directly with the C-clutch 120C. To the C-coupling gear 117C, the driving force from the development motor 3D may be transmitted through the idle gears 110B, 113B, 115C, and the C-clutch 120C.

The idle gear 113C is arranged at a rearward position with respect to the idle gear 115C and meshes directly with the idle gear 115C. The idle gear 115K is arranged at a rearward position with respect to the idle gear 113C and meshes directly with the idle gear 113C. The K-clutch 120K is arranged at a position below the idle gear 115K and meshes directly with the idle gear 115K.

The K-coupling gear 117K may output the driving force from the development motor 3D input through the idle gear 110B to the K-developing roller 61K. The K-coupling gear 117K is arranged at a frontward position with respect to the K-clutch 120K and meshes directly with the K-clutch 120K. To the K-coupling gear 117K, the driving force from the development motor 3D may be transmitted through the idle gears 110B, 113B, 115C, 113C, 115K, and the K-clutch 120K.

The coupling gear 117 includes a coupling shaft 119, and the coupling gear 117 and the coupling shaft 119 rotate integrally. The coupling shaft 119 is movable in a direction of an axis thereof in cooperation with opening/closing motions of the front cover 11 (see FIG. 1). The coupling shaft 119 may engage with a coupling (not shown) in the developing cartridge 60 when the front cover 11 is closed. While the coupling shaft 119 is engaged with the coupling in the developing cartridge 60, and when the coupling gear 117 rotates, the driving force from the developing motor 3D may be transmitted to the developing roller 61, causing the developing roller 61 to rotate.

As shown in FIGS. 5 and 6, the first control-gear train 100C includes idle gears 131A, 131B, a YMC-electromagnetic clutch 140A, idle gears 133A, 134A, the Y-cam 150Y including a gear portion 150G an idle gear 135, the M-cam 150M including a gear portion 150G an idle gear 136, and the C-cam 150C including a gear portion 150G.

The idle gear 131A meshes directly with the idle gear 110A, which forms a part of the first development-gear train 100A, and is arranged at a frontward position with respect to the idle gear 110A. On the other hand, the idle gear 131A does not directly mesh with the development-driving gear 100G. The idle gear 131B is arranged at a frontward position with respect to the idle gear 131A and meshes directly with the idle gear 131A.

The YMC-electromagnetic clutch 140A is arranged at a frontward position with respect to the idle gear 131A. The YMC-electromagnetic clutch 140A includes a larger-diameter gear 140L and a smaller-diameter gear 140S. The larger-diameter gear 140L meshes directly with the idle gear 131B.

The idle gear 133A is arranged at a position below the YMC-electromagnetic clutch 140A and meshes directly with the smaller-diameter gear 140S of the YMC-electromagnetic clutch 140A. The idle gear 134A is arranged at a rearward position with respect to the idle gear 133A and meshed directly with the idle gear 133A. At the same time, the idle gear 134A meshes directly with the gear portion 150G of the Y-cam 150Y, which is located at a rearward position with respect to the idle gear 134A.

The idle gear 135 is arranged between the Y-cam 150Y and the M-cam 150M and meshes directly with the gear portion 150G of the Y-cam 150Y and with the gear portion 150G of the M-cam 150M. The idle gear 136 is arranged between the M-cam 150M and the C-cam 150C and meshes directly with the gear portion 150G of the M-cam 150M and the gear portion 150G of the C-cam 150C.

To the Y-cam 150Y, the driving force from the development motor 3D may be transmitted through the idle gears 110A, 131A, 131B, the YMC-electromagnetic clutch 140A, and the idle gears 133A, 134A. To the M-cam 150M, the driving force may be transmitted through the Y-cam 150Y and the idle gear 135. To the C-cam 150C, the driving force may be transmitted through the M-cam 150M and the idle gear 136.

The second control-gear train 100D includes idle gears 132A, 132B, 132C, 132D, a K-electromagnetic clutch 140K, idle gears 133B, 134B, and the K-cam 150K including a gear portion 150G.

The idle gear 132A meshes directly with the development-driving gear 100G and is arranged at a rearward position with respect to the development-driving gear 100G. The idle gear 132A is, at the same time, arranged at a rightward position with respect to the idle gear 110B, which forms a part of the second development-gear train 100B. The idle gear 132B is arranged at a rearward position with respect to the idle gear 132A and meshes directly with the idle gear 132A.

The idle gear 132C is arranged at a rearward position with respect to the idle gear 132B and meshes directly with the idle gear 132B. The idle gear 132D is arranged at a rearward position with respect to the idle gear 132C and meshes directly with the idle gear 132C.

The K-electromagnetic clutch 140K is arranged at a rearward position with respect to the idle gear 132D. The K-electromagnetic clutch 140K includes a larger-diameter gear 140L and a smaller-diameter gear 140S. The larger-diameter gear 140L meshes directly with the idle gear 132D.

The idle gear 133B is arranged at a rearward position with respect to the K-electromagnetic clutch 140K and meshes directly with the smaller-diameter gear 140S of the K-electromagnetic clutch 140K. The idle gear 134B is arranged at a lower-rearward position with respect to the idle gear 133B and meshed directly with the idle gear 133B. At the same time, the idle gear 134B meshes directly with the gear portion 150G of the K-cam 150K, which is located at a position below the idle gear 134B.

To the K-cam 150K, the driving force from the development motor 3D may be transmitted through the idle gears 132A-132D, the K-electromagnetic clutch 140K, and the idle gears 133B, 134B.

The YMC-electromagnetic clutch 140A and the K-electromagnetic clutch 140K may switch transmission and disconnection of the driving force to switch states of the Y-, M-, C-cams 150Y, 150M, 150C and the K-cam 150K, respectively, between rotating and stationary. In particular, when the electromagnetic clutch 140 is activated by being powered on, the larger-diameter gear 140L and the smaller-diameter gear 140S may integrally rotate. Thereby, the driving force may be transmitted to the cam(s) 150 corresponding to the electromagnetic clutch 140, and the cam(s) 150 may rotate. On the other hand, when the electromagnetic clutch 140 is deactivated by being powered off, the larger-diameter gear 140L may idle with respect to the smaller-diameter gear 140S, which bears the load from the gears downstream in the transmission flow causing the smaller-diameter gear 140S to stay stationary without rotating. Therefore, the driving force may be discontinued between the larger-diameter gear 140L and the smaller-diameter gear 140S, and the cam(s) 150 may stay stationary. Activation or deactivation of the YMC- and K-electromagnetic clutches 140A, 140K may be controlled individually by the controller 2.

The YMC-moving mechanism 5A includes the Y-, M-, C-cams 150Y, 150M, 150C, and a plurality of cam followers 170, each of which corresponds to one of the Y-, M-, C-cams 150Y, 150M, 150C. The K-moving mechanism 5K includes the K-cam 150K and a cam follower 170 corresponding to the K-cam 150K.

Figure 7A:
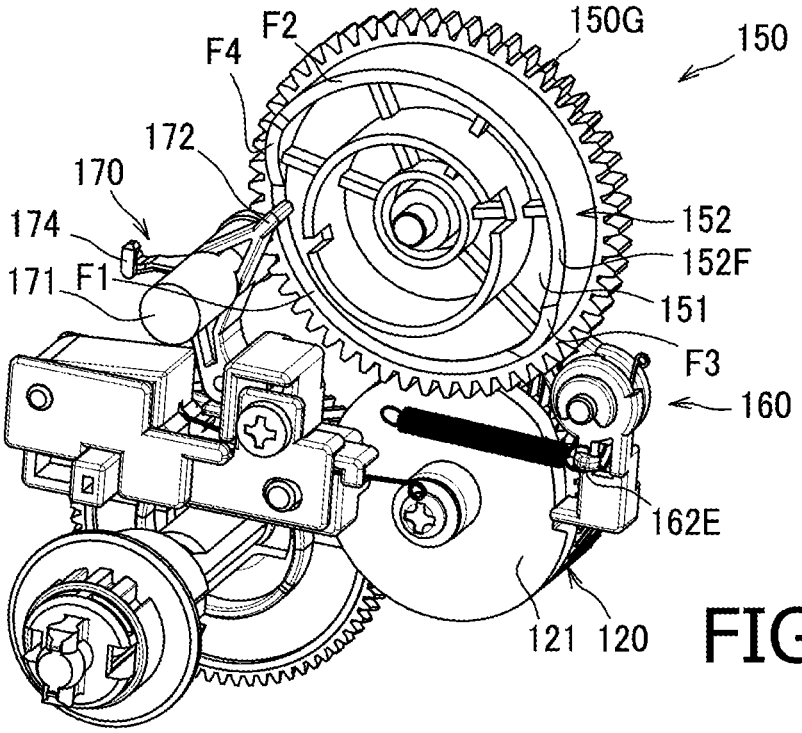
FIGS. 7A and 7B are a perspective view and a side view, respectively, of a cam, a cam follower, a clutch, and a restrictive member when a developing roller is at a contacting position in the image forming apparatus according to the embodiment of the present disclosure.
Figure 7B:
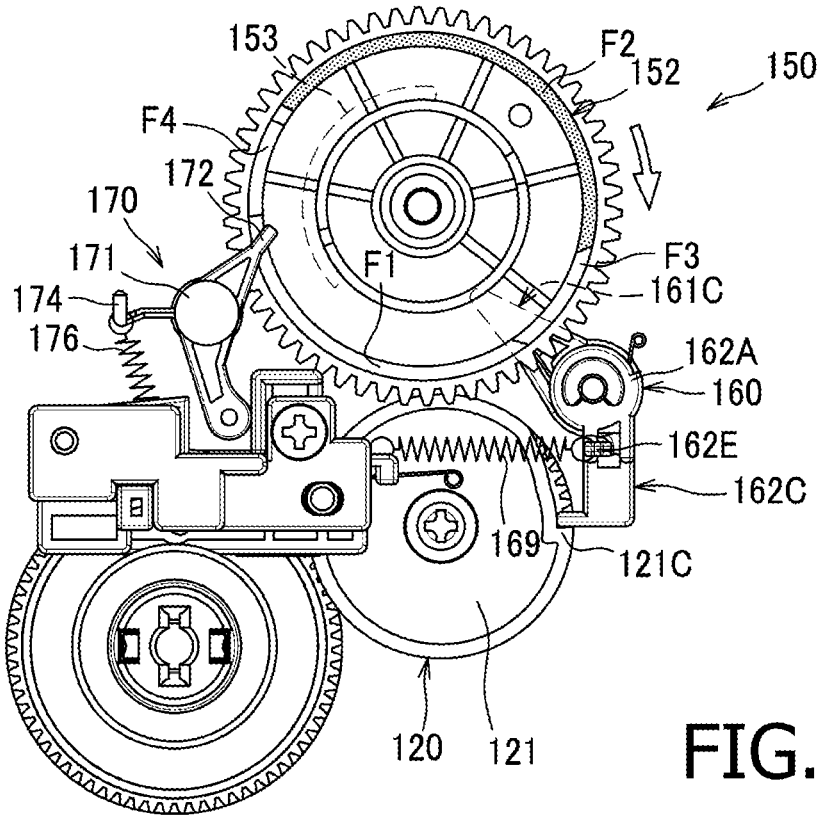

The cam 150 may move the corresponding developing roller 61 between the contacting position and the separated position by rotating. As shown in FIGS. 7A-7B, the cam 150 includes a disk portion 151, the gear portion 150G formed on an outer circumference of the disk portion 151, a first cam portion 152, and a second cam portion 153.

The first cam portion 152 may move the developing roller 61 between the contacting position and the separated position and protrudes from a sideward face of the disk portion 151 in an axial direction of the developing roller 61. The first cam portion 152 includes a cam face 152F at an end thereof in the axial direction. The cam face 152F includes a first retainer face F1, a second retainer face F2, a first guide face F3, and a second guide face F4.

The first retainer face F1 may retain the cam follower 170 at a standby position, which will be described further below. The second retainer face F2 may retain the cam follower 170 at a protrusive position, which will be described further below. The second retainer face F2 is indicated by dot-hatching in the first cam portion 152 shown in, for example, FIG. 7B. The first guide face F3 connects the first retainer face F1 and the second retainer face F2 and inclines with respect to the first retainer face F1. The second guide face F4 connects the second retainer face F2 and the first retainer face F1 and inclines with respect to the first retainer face F1.

The second cam portion 153 works in cooperation with a restrictive member 160, which will be described further below, to switch conditions of the clutch 120. The second cam portion 153 extends in an arc in a view along the axial direction of the developing roller 61 and protrudes from the other sideward face of the disk portion 151 opposite to the sideward face, on which the first cam portion 152 is formed.

The cam follower 170 includes a slidable shaft 171, a contact portion 172, and a spring hook 174. The slidable shaft 171 is slidably supported by a supporting shaft 179 (see FIG. 8B), which is fixed to the casing 10, to slide in the axial direction of the developing roller 61. Therefore, the cam follower 170 is slidable in the axial direction.

The contact portion 172 extends from the slidable shaft 171 and may contact the cam face 152F of the first cam portion 152. The cam follower 170 is slidably movable between the protrusive position (see FIG. 8B), at which the contact portion 172 may contact the second retainer face F2 and locate the developing roller 61 at the separated position, and the standby position (see FIG. 8A), at which the contact portion 172 may contact the first retainer face F1 and locate the developing roller 61 at the contacting position.

Referring back to FIGS. 7A-7B, the spring hook 174 is a part, to which an end of a spring 176 is hooked, and extends from the slidable shaft 171 in a direction different from the contact portion 172. The spring 176 may be a contractive spring, and the other end of the spring 176 is hooked to another spring hook (not shown), which a part of the casing 10 located at a lower-leftward position with respect to the spring hook 174. The spring 176 may urge the cam follower 170 in a direction from the protrusive position toward the standby position.

Figures 8A, 8B:
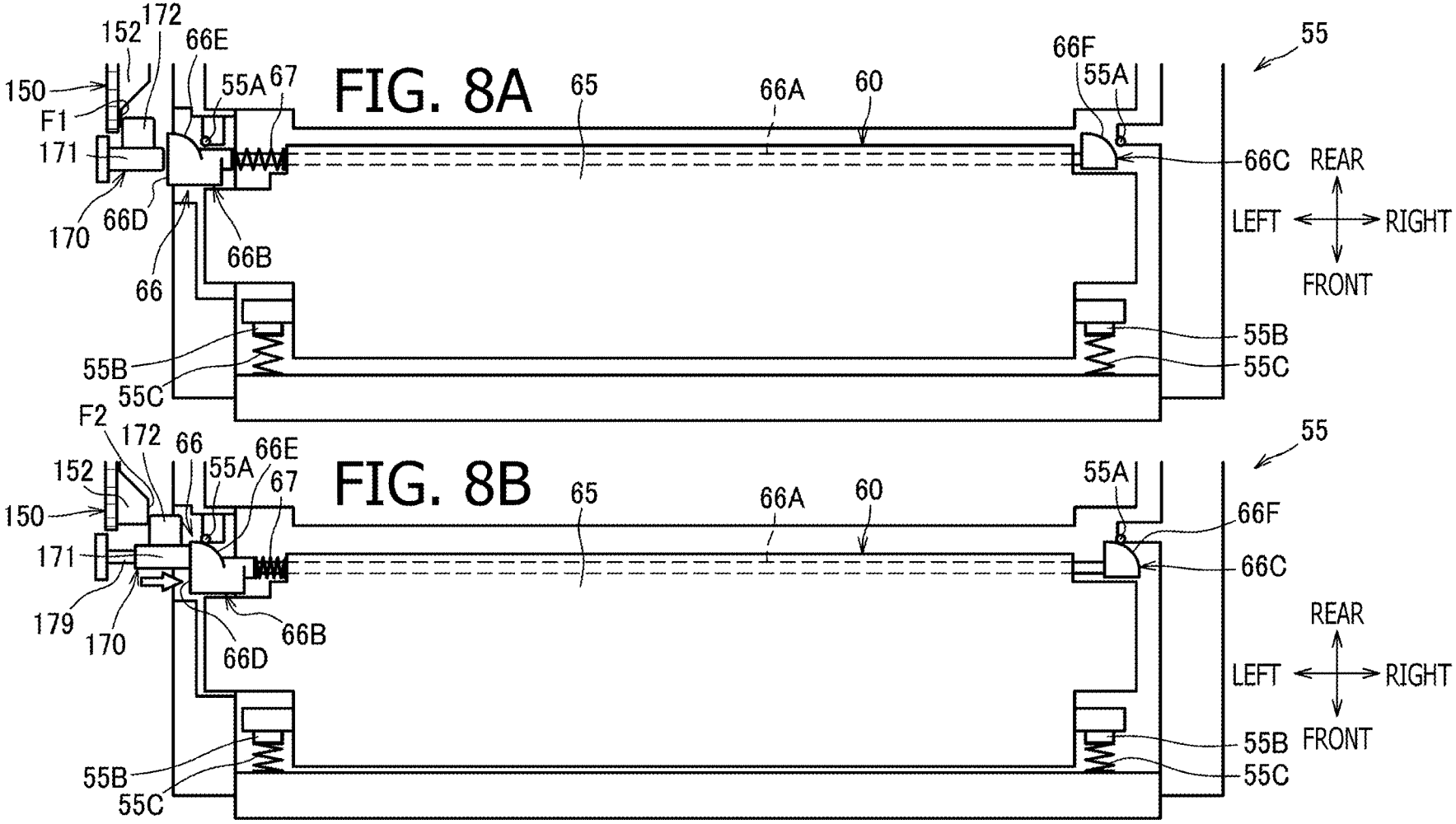
FIGS. 8A and 8B are upper-side plan views of a developing cartridge and periphery thereof in the image forming apparatus according to the embodiment of the present disclosure.

As shown in FIGS. 8A-8B, the developing cartridge 60 is supported by the supporting member 55 movably in the front-rear direction. The supporting member 55 includes passive-contact portions 55A and pressing members 55B. Each passive-contact portion 55A is a part of the supporting member 55, at which a slider member 66 may contact, and includes a roller, which is rotatable about a shaft extending in the vertical direction. The slider member 66 will be described further below. Each pressing member 55B is urged rearward by a spring 55C. When the developing cartridge 60 is attached to the supporting member 55, the pressing members 55B may press the developing cartridge 60 to place the developing roller 61 at the contacting position, at which the developing roller 61 contacts the photosensitive drum 50.

The developing cartridge 60 includes a case 65 to contain toner and the slider member 66. The slider member 66 is slidable to move with respect to the case 65 in the axial direction of the developing roller 61. The slider member 66 may be pressed by the cam follower 170 to slidably move in the axial direction. The slider member 66 includes a shaft 66A, a first contact member 66B, and a second contact member 66C. The shaft 66A is slidably supported by the case 65. The first contact member 66B is fixed to one end, e.g., a leftward end, of the shaft 66A, and the second contact member 66C is fixed to the other end, e.g., a rightward end, of the shaft 66A.

The first contact member 66B includes a pressing face 66D and an oblique face 66E, which inclines with respect to the axial direction. The second contact member 66C includes an oblique face 66F, which inclines similarly to the oblique face 66E. The pressing face 66D is a face to be pressed by the cam follower 170. The oblique faces 66E, 66F may, when the slider member 66 is pressed by the cam follower 170 in the axial direction, contact the passive-contact portions 55A and urge the developing cartridge 60 in a direction intersecting orthogonally with the axial direction to move the developing cartridge 60 to the separated position, at which the developing roller 61 is separated from the photosensitive drum 50. At a position between the first contact member 66B and the case 65, arranged is a spring 67, which urges the slider member 66 leftward.

Figure 9A:
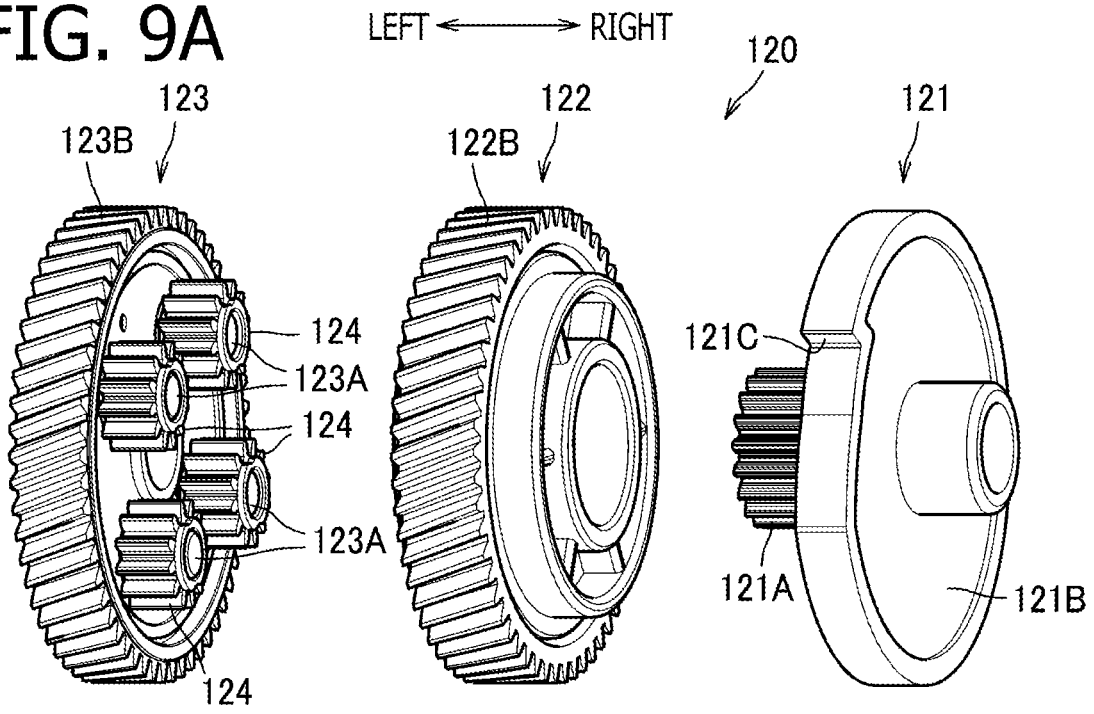
FIGS. 9A and 9B are exploded views of the clutch in the image forming apparatus according to the embodiment of the present disclosure, viewed from a side of a sun gear and a side of a carrier, respectively.
Figure 9B:
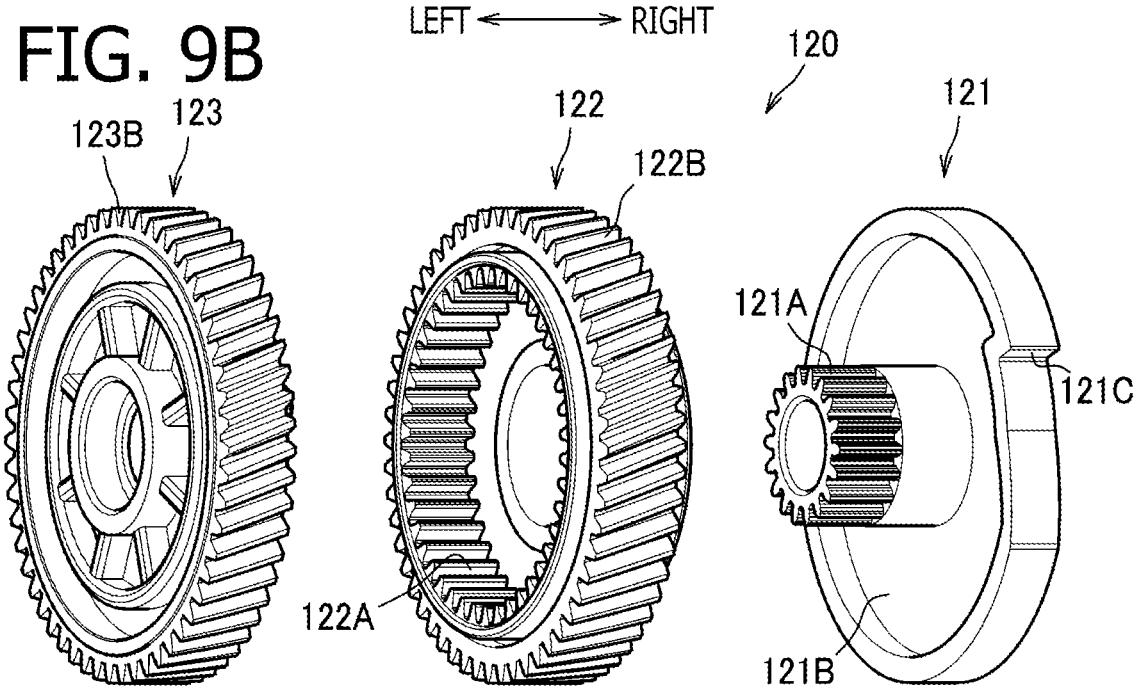

As shown in FIGS. 9A-9B, the clutch 120, including the Y-clutch 120Y, the M-clutch 120M, the C-clutch 120C, and the K-clutch 120K, is switchable between an engaging state, in which the clutch 120 engages transmission of the driving force input through the idle gears 110A, 110B (see FIG. 4) to the developing roller 61, and a disengaging state, in which the clutch 120 disengages transmission of the driving force input through the idle gears 110A, 110B to the developing roller 61. The clutch 120 includes a planetary gear assembly. For example, the clutch 120 may include a sun gear 121, which is rotatable about an axis, a ring gear 122, a carrier 123, and planetary gears 124 supported by the carrier 123.

The sun gear 121 includes a gear portion 121A, a disc portion 121B rotatable integrally with the gear portion 121A, and a claw portion 121C arranged on an outer circumference of the disc portion 121. The ring gear 122 includes an inner gear 122A arranged on an inner circumferential surface and an input gear 122B arranged on an outer circumferential surface. The input gear 122B meshes directly with the idle gear 115 (see FIG. 4).

The carrier 123 includes four (4) shaft portions 123A, which support the planetary gears 124 rotatably, and an output gear 123B, which is arranged on an outer circumferential surface of the carrier 123. The output gear 123B meshes directly with the coupling gear 117 (see FIG. 4). The planetary gears 124 include four (4) planetary gears 124, each of which is supported by one of the shaft portions 123A in the carrier 123. The planetary gears 124 mesh with the gear portion 121A of the sun gear 121 and with the inner gear 122A in the ring gear 122.

When the sun gear 121 is restrained from rotating, the clutch 120 is in the engaging state, in which the driving force input through the input gear 122B may be transmitted to the output gear 123B. On the other hand, when the sun gear 121 is allowed to rotate, the clutch 120 is in the disengaging state, in which the driving force input through the input gear 122B is not transmittable to the output gear 123B. When the clutch 120 is in the disengaging state, and the output gear 123B is under load, and when the driving force is input through the input gear 122B, the output gear 123B does not rotate, and the sun gear 121 idles.

As shown in FIGS. 7A-7B, the driving-force transmission mechanism 100 includes the restrictive member 160. The restrictive member 160 includes four (4) restrictive members 160, each of which corresponds to one of the Y-, M-, C-, and K-clutches 120Y, 120M, 120C, 120K. Each restrictive member 160 includes a rotation-supporting portion 162A, a first arm 161C extending from the rotation-supporting portion 161A, and a second arm 162C extending from the rotation-supporting portion 162A in a direction different from the first arm 161C. The rotation-supporting portion 162A is rotatably supported by a supporting shaft, which is not shown but is arranged on the casing 10.

The second arm 162C extends in an arrangement such that a tip end thereof points at an outer circumferential surface of the sun gear 121. The second arm 162C has the spring hook 162E, to which an end of a spring 169 is hooked. The spring 169 may be a contractive spring, and the other end of the spring 169 is hooked to a spring hook, which is not shown, formed at a frontward position with respect to the spring hook 162E. Thus, the spring 169 may urge the restrictive member 160 to rotate from a separated position to an engaged position, e.g., clockwise in FIGS. 7A-7B. The separated position and the engaged position will be described further below.

Figure 10A:
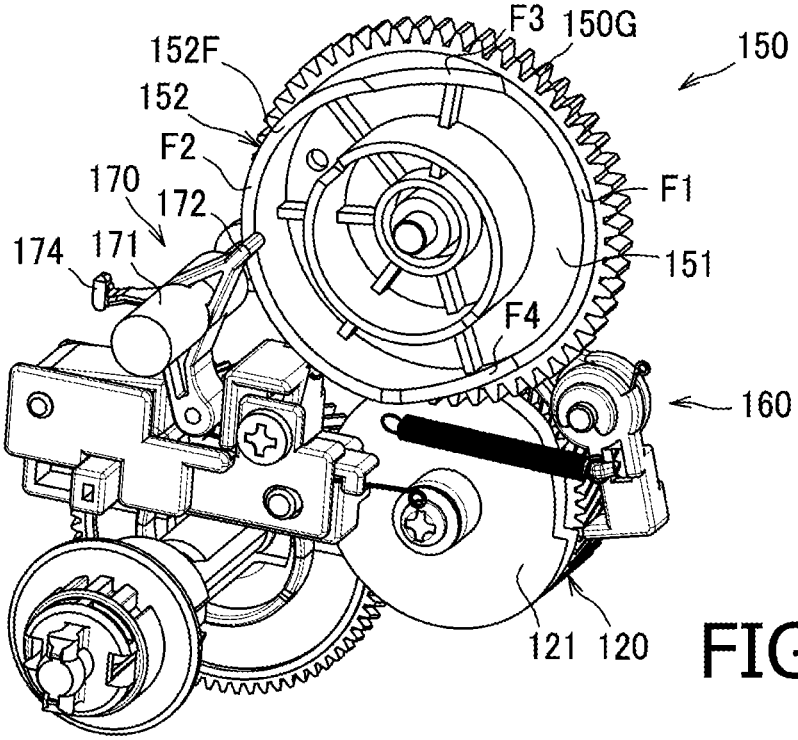
FIGS. 10A and 10B are a perspective view and a side view, respectively, of the cam, the cam follower, the clutch, and the restrictive member when the developing roller is at a separated position in the image forming apparatus according to the embodiment of the present disclosure.
Figure 10B:
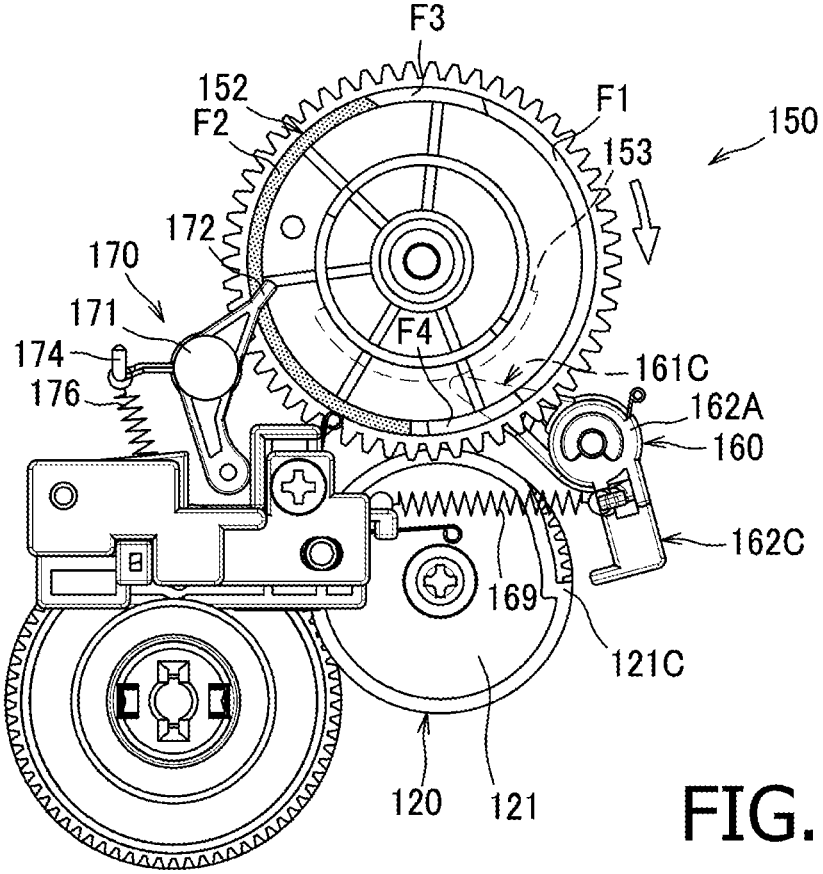

The restrictive member 160 is movable to swing between the engaged position, at which a tip end of the second arm 162C engages with the claw portion 121C in the sun gear 121 to restrict the sun gear 121 from rotating, and the separated position, at which the tip end of the second arm 162C is separated from the claw portion 121C to allow the sun gear 121 to rotate (see FIGS. 10A-10B).

Meanwhile, the restrictive member 160 may contact the second cam portion 153 at a tip end of the first arm 161C. When the tip end of the first arm 161C is separated from the second cam portion 153, the restrictive member 160 is placed at the engaged position by the urging force of the spring 169, and when the tip end of the first arm 161C contacts the second cam portion 153 (see FIGS. 10A-10B), the restrictive member 160 may swing against the urging force of the spring 169 and may be located at the separated position.

The second cam portion 153 is formed in an arrangement such that the second cam portion 153 may locate the restrictive member 160 at the engaged position to place the clutch 120 in the engaging state before the developing roller 61 moving from the separated position to the contacting positions contacts the photosensitive drum 50 and locate the restrictive member 160 at the separated position to place the clutch 120 in the disengaging state after the developing roller 61 moving from the contacting position to the separated position separates from the photosensitive drum 50. Therefore, the developing roller 61 may rotate when the developing roller 61 is at the contacting position and stays stationary when the developing roller 61 is at the separated position.

The controller 2 may control overall actions in the image forming apparatus 1. The controller 2 includes a CPU, a ROM, a RAM, and an input/output device, which are not shown. The controller 2 may execute predetermined programs to process operations. For example, the controller 2 may control activation and deactivation of the YMC-clutch 140A and the K-clutch 140K to control the contacting and separating motions of the developing roller 61 with respect to the photosensitive drum 50.

In the following paragraphs, exemplary processes to be executed by the controller 2 will be described. When the image forming apparatus 1 is standing by for a print job, the developing roller, 61 including the Y-, M-, C-, K-developing rollers 61Y, 61M, 61C, 61K, is located at the separated position, and the cam follower 170 is at the protrusive position, as shown in FIGS. 10A-10B, at which the contact portion 172 contacts the second retainer face F2 of the cam 150.

When a print job for forming an image is received, the controller 2 may drive the development motor 3D and activate the YMC-electromagnetic clutch 140A and/or the K-electromagnetic clutch 140K, depending on the colors of the toners to be used for forming the image, to rotate the cam 150 clockwise in FIGS. 10A-10B. Thereby, the contact portion 172 in the cam follower 170 may be guided from the second retainer face F2 to the second guide face F4, slide on the second guide face F4, and contact the first retainer face F1, as shown in FIGS. 7A-7B. Thus, the cam follower 170 may be slidably moved by the urging force of the spring 176 from the protrusive position shown in FIG. 8B to the standby position shown in FIG. 8A, causing the developing roller 61 to move from the separated position to the contacting position. When the developing roller 61 is located at the contacting position, the controller 2 may deactivate the YMC-electromagnetic clutch 140A and/or the K-electromagnetic clutch 140K to stop rotation of the cam 150.

When the developing roller 61 finishes developing the image, the controller 2 may activate the YMC-electromagnetic clutch 140A and/or the K-electromagnetic clutch 140K to rotate the cam 150 clockwise in FIGS. 7A-7B again. Thereby, the contact portion 172 may be guided from the first retainer face F1 to the first guide face F3, slide on the first guide face F3, and contact the second retainer face F2, as shown in FIGS. 10A-10B. Accordingly, the cam follower 170 may slidably move to the standby position shown in FIG. 8A to the protrusive position shown in FIG. 8B, causing the developing roller 61 to move from the contacting position to the separated position. When the developing roller 61 is located at the separated position, the controller 2 may deactivate the YMC-electromagnetic clutch 140A and/or the K-electromagnetic clutch 140K to stop rotation of the cam 150.

According to the embodiment described above, the first and second development-driving gear trains 100A, 100B, which may transmit the driving force from the development motor 3D to the developing roller 61, and the second-control gear train 100D, which may transmit the driving force from the development motor 3D to the K-moving mechanism 5, are separated. Therefore, the first and second development-gear trains 100A, 100B may be restrained from being affected by fluctuation of the torque, which may be caused when the K-driving mechanism 5K are active or deactivated.

Moreover, the development-driving gear 100G is the gear attached to the output shaft 3A of the development motor 3D. Therefore, compared to a case, in which another gear intervenes between the development-driving gear 100G and a gear attached to the output shaft 3A of the development motor 3D, a quantity of the gears may be reduced. Therefore, a volume and a manufacturing cost for the driving-force transmission mechanism 100 to transmit the driving force from the development motor 3D to the developing roller 61 and the YMC- and K-moving mechanisms 5A, 5K may be reduced. Moreover, while the quantity of the gears is reduced, for example, intensities of friction forces that may affect shafts in the gears, intensities of friction forces that may be produced between the gears and the shafts, and intensities of friction forces that may be produced between teeth in the intermeshing gears, may be reduced. Therefore, an amount of loss of the driving force may be reduced.

Meanwhile, the first control-gear train 100C, which may transmit the driving force from the development motor 3D to the YMC-moving mechanism 5A, is branched from the first development-gear train 100A. In other words, the first control-gear train 100C is connected to the first development-gear train 100A. Therefore, compared to a case, in which the first control-gear train is separated from the first development-gear train 100A, and in which the driving force from the development motor 3D is input from the development-driving gear 100G directly to the first control-gear train, the development-driving gear 100G and the development motor 3D may be arranged more freely, and a degree of freedom for designing the image forming apparatus 1 may be increased.

Moreover, the first development-gear train 100A may transmit the driving force from the development motor 3D to two (2) of the four (4) developing rollers 61, e.g., the Y-developing roller 61Y and the M-developing roller 61M. Meanwhile, the second development-gear train 100B may transmit the driving force from the development motor 3D to the other two (2) of the developing rollers 61, e.g., the C-developing roller 61C and the K-developing roller 61K. Therefore, compared to, for example, a configuration, in which one of the two (2) development-gear trains may transmit the driving force to three (3) developing rollers among four (4) developing rollers, the torque to act on one of the idle gears 110A, 110B may be restrained from increasing. In the arrangement of these gear trains, without increasing the thicknesses of the idle tears 110A, 110B, deformation of teeth in the idle gears 110A, 110B may be restrained. Moreover, intensities of the torque to act on the first development-gear train 100A and the torque to act on the second development-gear train 100B may be substantially equalized; therefore, some or at least a part of the gears may be commonly prepared for the first development-gear train 100A and the second development-gear train 100B. Therefore, volumes and manufacturing costs for the driving-force transmission mechanism 100 may be reduced. Moreover, by using the commonly designed parts, deviation or irregularities in rotations of the gears in the first and second development-gear trains 100A, 100B may be restrained; therefore, the developing roller 61 may be driven stably.

Moreover, while four (4) developing rollers, i.e., the Y-, M-, C-, K-developing rollers 61Y, 61M, 61C, 61K, align in line in this recited order from upstream to downstream in the sheet-conveying direction, the YMC-moving mechanism 5A may move the three (3) developing rollers, i.e., the Y-, M-, C-developing rollers 61Y, 61M, 61C. Therefore, compared to a case, in which, for example, the K-developing roller 61K is arranged between the Y-developing roller 61 and the M-developing roller 61M or between the M-developing roller 61M and the C-developing roller 61C, the YMC-moving mechanism 5A and the driving-force transmission mechanism 100 may be downsized, and structures of the YMC-moving mechanism 5A and the driving-force transmission mechanism 100 may be simplified.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the following description, items or structures which are identical or equivalent to those described in the previous embodiment may be referred to by the same reference signs, and explanation of those will be omitted.

Figure 11:
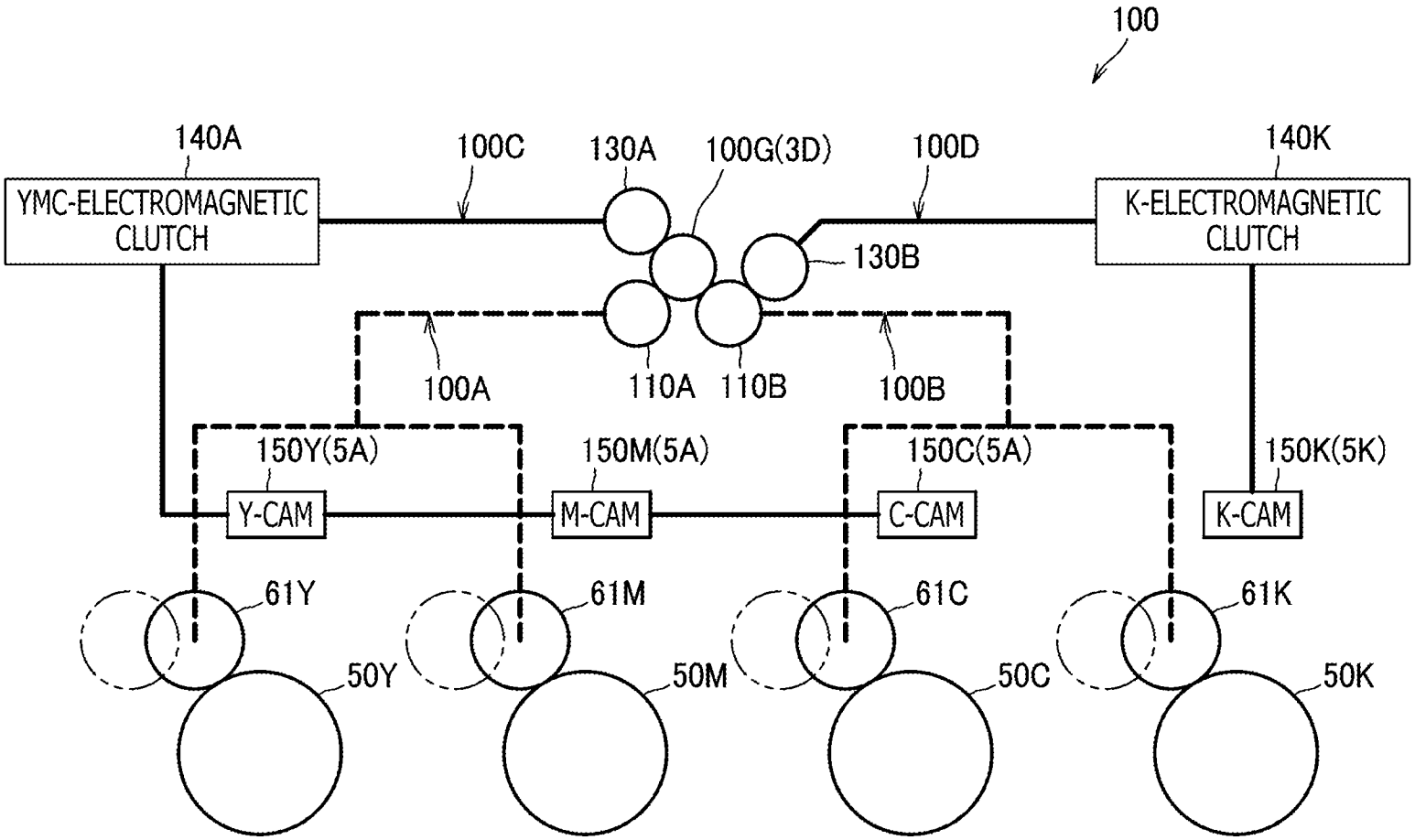
FIG. 11 is a schematic diagram to illustrate a first modified example of the driving-force transmission mechanisms in the image forming apparatus according to the embodiment of the present disclosure.

For example, the first control-gear train 100C for multicolor printing, which may transmit the driving force from the development motor 3D to the YMC-moving mechanism 5A, may not necessarily be branched from the first development-gear train 100A; or the second control-gear train 100D for monochrome printing, which may transmit the driving force from the development motor 3D to the K-moving mechanism 5K, may not necessarily be provided separately from the first development-gear train 100A or from the second development-gear train 100B, as shown in FIG. 2. For example, as shown in FIG. 11, the first control-gear train 100C for multicolor printing may be provided separately from the first development-gear train 110A and the second development-gear train 100B, while the second control-gear train 100D for monochrome printing may be branched from the second development-gear train 100B. In this arrangement, the first control-gear train 100C may have an idle gear 130A, which meshes directly with the development-driving gear 100G; and the second control-gear train 100D may have an idle gear 130B, which meshes directly with the idle gear 110B forming a part of the second development-gear train 100B.

Figure 12:
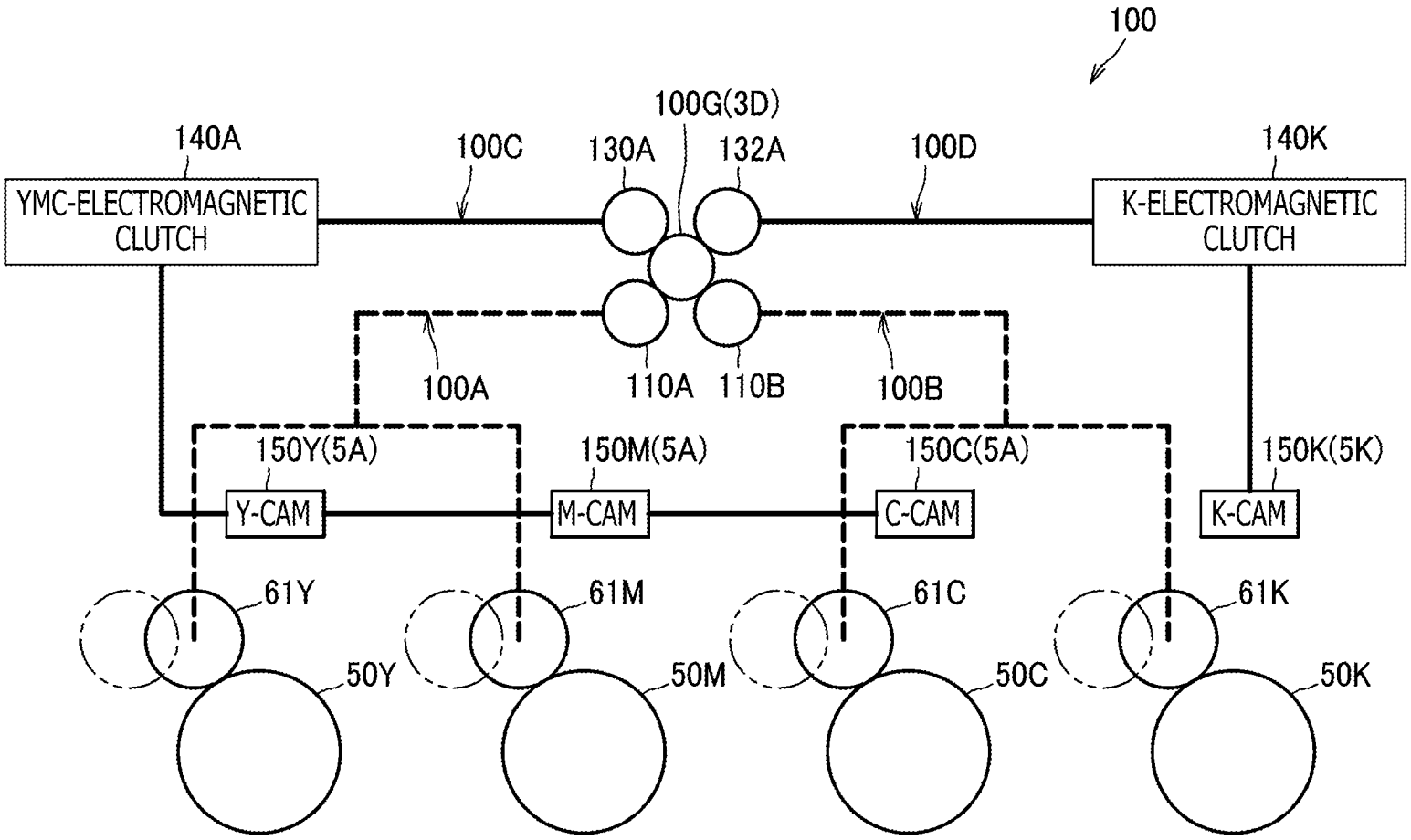
FIG. 12 is a schematic diagram to illustrate a second modified example of the driving-force transmission mechanisms in the image forming apparatus according to the embodiment of the present disclosure.
Figure 13:
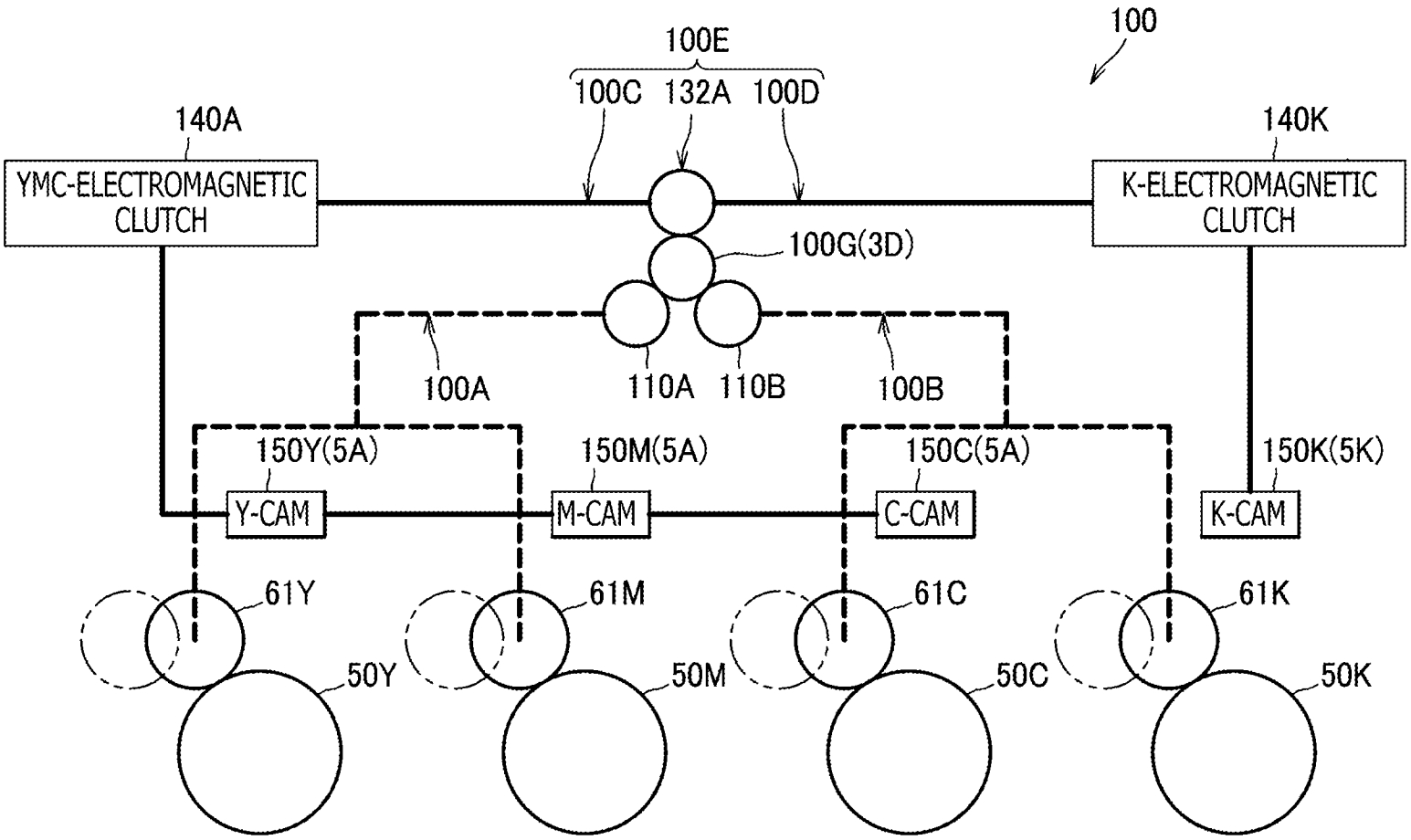
FIG. 13 is a schematic diagram to illustrate a third modified example of the driving-force transmission mechanisms in the image forming apparatus according to the embodiment of the present disclosure.

For another example, as shown in FIGS. 12-13, both the first control-gear train 100C for multicolor printing and the second control-gear train 100D for monochrome printing may be separated from the first development-gear train 100A and from the second development-gear train 100B.

In particular, as shown in FIG. 12, the first control-gear train 100C for multicolor printing may transmit the driving force from the development motor 3D to the YMC-moving mechanism 5A, and the second control-gear train 100D for monochrome printing may transmit the driving force from the development motor 3D to the K-moving mechanism 5K. The first control-gear train 100C and the second control-gear train 100D may be separated from each other. The first control-gear train 100C may have an idle gear 130A, which meshes directly with the development-driving gear 100G. In this arrangement, the first and second development-gear trains 100A, 100B may be restrained from being affected by fluctuation of the torque, which may be caused when the K-driving mechanism 5K is active or deactivated.

For another example, as shown in FIG. 13, the first control-gear train 100C for multicolor printing and the second control-gear train 100D for monochrome printing may commonly have an idle gear 132A, which is a gear meshing directly with the development-driving gear 100G. The first control-gear train 100C, the second control-gear train 100D, and the idle gear 132A may form a control-gear train 100E. In other words, the driving-force transmission mechanism 100 may have the development-driving gear 100G, the first development-gear train 100A, the second development-gear train 100B, and the control-gear train 100E. The control-gear train 100E may be a gear train, which may transmit the driving force from the development motor 3D to both the YMC-moving mechanism 5A and the K-moving mechanism 5K. In this arrangement, the first and second development-gear trains 100A, 100B may as well be restrained from being affected by fluctuation of the torque, which may be caused when the K-driving mechanism 5K is active or deactivated.

Figure 14:
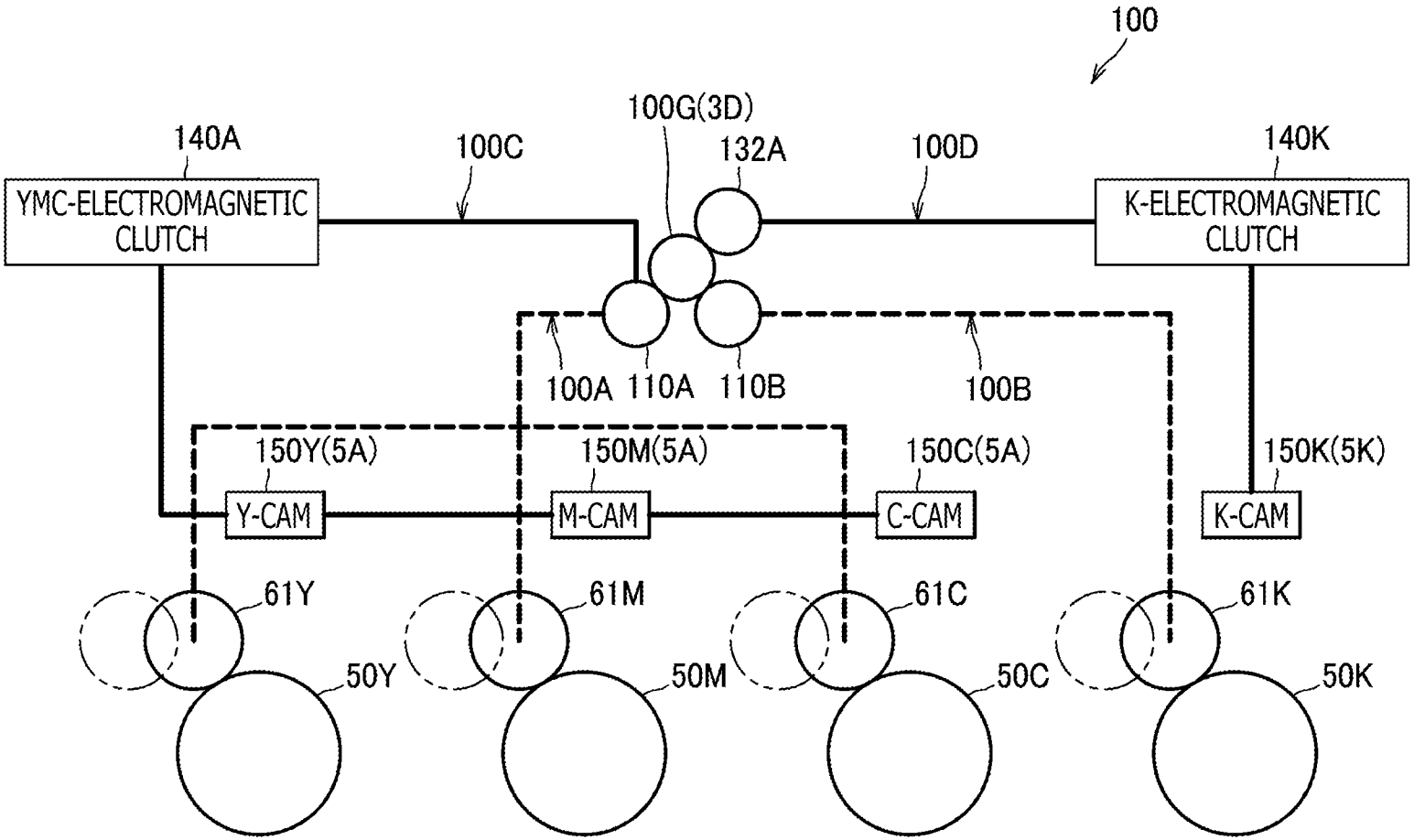
FIG. 14 is a schematic diagram to illustrate a fourth modified example of the driving-force transmission mechanisms in the image forming apparatus according to the embodiment of the present disclosure.

For another example, the first and second development-gear trains 100A, 100B may not necessarily be in the arrangement such that the first development-gear train 100A transmits the driving force from the development motor 3D to two (2) of the Y-, M-, C-, K-developing rollers 61Y, 61M, 61C, 61K, e.g., the Y- and M-developing rollers 61Y, 61M, and the second development-gear train 100B transmits the driving force from the development motor 3D to the other two (2) of the Y-, M-, C-, K-developing rollers 61Y, 61M, 61C, 61K, e.g., the C- and K-developing rollers 61C, 61K, as shown in FIG. 2. The first development-gear train 100A may, as shown in FIG. 14, transmit the driving force from the development motor to three (3) developing rollers, e.g., Y-, M-, C-developing rollers 61Y, 61M, 61C, and the second development-gear train 100B may transmit the driving force from the development motor to one (1) developing roller, e.g., the K-developing roller 61K, alone. In this arrangement, the development-driving gear 100G and the development motor 3D may be arranged more freely, and a degree of freedom for designing the image forming apparatus 1 may be increased.

For another example, the K-developing roller 61K may not necessarily be arranged at the downstream position with respect to the C-developing roller 61C in the sheet-conveying direction. For example, while the Y-developing roller 61Y, the M-developing roller 61M, and the C-developing roller 61C are arranged to align in this recited order from upstream to downstream in the sheet-conveying direction, the K-developing roller 61K may be arranged at an upstream position with respect to the Y-developing roller 61Y in the sheet-conveying direction. In other words, the K-developing roller 61K, the Y-developing roller 61Y, the M-developing roller 61M, and the C-developing roller 61C may be arranged in this recited order from upstream to downstream in the sheet-conveying direction.

For another example, the development-driving gear 100G may not necessarily be the gear attached to the output shaft 3A of the development motor 3D but may be arranged to mesh directly with a gear, which is attached to the output shaft 3A of the development motor 3D, or may mesh indirectly with the gear attached to the output shaft 3A of the development motor 3D through one or more intervening idle gear(s).

For another example, the idle gear 131A to connect the first control-gear train 100C to the first development-gear train 100A may not necessarily mesh directly with the idle gear 110A, which meshes directly with the development-driving fear 100G among the gears that form the first development-gear train 100A, but the idle gear 131A may mesh directly with any one of the gears in the first development-gear train 100A.

For another example, the YMC- and K-moving mechanisms 5A, 5B may be equipped with a linear motion cam in place of the rotatable cams 150. For another example, the developing roller 61 may not necessarily be movable in the front-rear direction to move between the contacting position and the separated position but may be movable vertically to move between the contacting position and the separated position.

For another example, the quantity of the photosensitive drums 50 and the developing rollers 61 may not necessarily be limited to four (4), but the image forming apparatus may have, for example, two, three, five, or more photosensitive drums 50 and the developing rollers 61. For another example, the image forming apparatus may not necessarily be limited to a printer but may be a multifunction peripheral machine or a copier.

For another example, the items illustrated in the embodiment and the modified examples may optionally be combined.

What is claimed is:

1. An image forming apparatus, comprising:

a first photosensitive drum;

a second photosensitive drum;

a first developing roller movable between a contacting position, in which the first developing roller contacts the first photosensitive drum, and a separated position, in which the first developing roller is separated from the first photosensitive drum;

a second developing roller movable between a contacting position, in which the second developing roller contacts the second photosensitive drum, and a separated position, in which the second developing roller is separated from the second photosensitive drum;

a first moving mechanism configured to move the first developing roller between the contacting position and the separated position;

a second moving mechanism configured to move the second developing roller between the contacting position and the separated position;

a driving gear;

a motor configured to drive the driving gear;

a first gear train having a first gear meshing directly with the driving gear, the first gear train being configured to transmit a driving force from the motor to the first developing roller;

a second gear train having a second gear meshing directly with the driving gear, the second gear train being configured to transmit the driving force from the motor to the second developing roller, the second gear train being provided separately from the first gear train; and a third gear train having a third gear meshing directly with the driving gear, the third gear train being configured to transmit the driving force from the motor to at least one of the first moving mechanism and the second moving mechanism, the third gear train being provided separately from the first gear train and the second gear train.

2. The image forming apparatus according to claim 1, wherein the driving gear is a gear attached to an output shaft of the motor.

3. The image forming apparatus according to claim 1, wherein the third gear train is configured to transmit the driving force from the motor to the first moving mechanism, and wherein the image forming apparatus further comprises a fourth gear train having a fourth gear, the fourth gear meshing directly with a gear forming a part of the second gear train, the fourth gear train being configured to transmit the driving force from the motor to the second moving mechanism, the fourth gear train being provided separately from the third gear train.

4. The image forming apparatus according to claim 1, wherein the third gear train is configured to transmit the driving force from the motor to both of the first moving mechanism and the second moving mechanism.

5. The image forming apparatus according to claim 1, wherein the third gear train is configured to transmit the driving force from the motor to the first moving mechanism, and wherein the image forming apparatus further comprises a fourth gear train having a fourth gear, the fourth gear meshing directly with the driving gear, the fourth gear train being configured to transmit the driving force from the motor to the second moving mechanism, the fourth gear train being provided separately from the third gear train.

6. The image forming apparatus according to claim 1, further comprising:

a third photosensitive drum;

a fourth photosensitive drum;

a third developing roller movable between a contacting position, in which the third developing roller contacts the third photosensitive drum, and a separated position, in which the third developing roller is separated from the third photosensitive drum; and a fourth developing roller movable between a contacting position, in which the fourth developing roller contacts the fourth photosensitive drum, and a separated position, in which the fourth developing roller is separated from the fourth photosensitive drum, wherein the first gear train is configured to transmit the driving force from the motor to the first developing roller and the fourth developing roller, and wherein the second gear train is configured to transmit the driving force from the motor to the second developing roller and the third developing roller.

7. The image forming apparatus according to claim 1, further comprising:

a third photosensitive drum;

a fourth photosensitive drum;

a third developing roller movable between a contacting position, in which the third developing roller contacts the third photosensitive drum, and a separated position, in which the third developing roller is separated from the third photosensitive drum; and a fourth developing roller movable between a contacting position, in which the fourth developing roller contacts the fourth photosensitive drum, and a separated position, in which the fourth developing roller is separated from the fourth photosensitive drum, wherein the second gear train is configured to transmit the driving force from the motor to the second developing roller, the third developing roller, and the fourth developing roller.

8. The image forming apparatus according to claim 1, further comprising:

a third photosensitive drum;

a fourth photosensitive drum;

a third developing roller movable between a contacting position, in which the third developing roller contacts the third photosensitive drum, and a separated position, in which the third developing roller is separated from the third photosensitive drum; and a fourth developing roller movable between a contacting position, in which the fourth developing roller contacts the fourth photosensitive drum, and a separated position, in which the fourth developing roller is separated from the fourth photosensitive drum, wherein the second moving mechanism is configured to move the second developing roller, the third developing roller, and the fourth developing roller between the respective contacting positions and the respective separated positions.

9. The image forming apparatus according to claim 8, wherein the second developing roller, the third developing roller, and the fourth developing roller are arranged in an order of the second developing roller, the third developing roller, and the fourth developing roller from upstream to downstream in a conveying direction to convey the sheet, and wherein the first developing roller is arranged one of upstream from the second developing roller and downstream from the fourth developing roller in the conveying direction.

* * * * *